US007911394B2

(12) United States Patent
Quintero Illera et al.

(10) Patent No.: US 7,911,394 B2
(45) **Date of Patent: *Mar. 22, 2011**

(54) MULTILEVEL AND SPACE-FILLING GROUND-PLANES FOR MINIATURE AND MULTIBAND ANTENNAS

(75) Inventors: Ramiro Quintero Illera, Barcelona (ES); Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 0 days.

This patent is subject to a terminal disclaimer.

(21) Appl. No.: 12/652,412

(22) Filed: Jan. 5, 2010

(65) Prior Publication Data

US 2010/0141548 A1 Jun. 10, 2010

Related U.S. Application Data

(63) Continuation of application No. 12/033,446, filed on Feb. 19, 2008, now Pat. No. 7,688,276, which is a continuation of application No. 10/797,732, filed on Mar. 10, 2004, now Pat. No. 7,362,283, which is a continuation of application No. PCT/EP01/10589, filed on Sep. 13, 2001.

(51) Int. Cl.
*H01Q 1/38* (2006.01)

(52) U.S. Cl. ..... 343/700 MS; 343/846

(58) Field of Classification Search ..... 343/846, 343/848, 700 MS

See application file for complete search history.

(56) References Cited

U.S. PATENT DOCUMENTS

| | | | |
|---|---|---|---|
| 3,696,438 | A | 10/1972 | Ingerson |
| 5,262,792 | A | 11/1993 | Egashira |
| 5,495,261 | A | 2/1996 | Baker et al. |
| 5,497,167 | A | 3/1996 | Luoma |
| 5,646,637 | A | 7/1997 | Miller |
| 5,703,600 | A | 12/1997 | Burrell et al. |
| 5,903,822 | A | 5/1999 | Sekine et al. |
| 5,945,954 | A | 8/1999 | Johnson |
| 6,002,367 | A | 12/1999 | Engblom et al. |
| 6,140,975 | A | 10/2000 | Cohen |
| 6,218,992 | B1 | 4/2001 | Sadler |
| 6,271,798 | B1 | 8/2001 | Endo et al. |
| 6,285,326 | B1 | 9/2001 | Diximus et al. |
| 6,314,273 | B1 | 11/2001 | Matsuda |
| 6,359,589 | B1 | 3/2002 | Bae |
| 6,362,790 | B1 | 3/2002 | Proctor, Jr. et al. |
| 6,366,243 | B1 | 4/2002 | Isohatala et al. |

(Continued)

FOREIGN PATENT DOCUMENTS

| | | | |
|---|---|---|---|
| CA | 2416437 | A1 | 7/2001 |

(Continued)

OTHER PUBLICATIONS

Shafai, L. L. et al, Dual-band dual-polarized perforated microstrip antennas for SAR applications, IEEE Transactions on antennas and propagation, Jan. 2000.

(Continued)

*Primary Examiner* — HoangAnh T Le
(74) *Attorney, Agent, or Firm* — Winstead PC

(57) ABSTRACT

An antenna system includes one or more conductive elements acting as radiating elements, and a multilevel or space-filling ground-plane, wherein said ground-plane has a particular geometry which affects the operating characteristics of the antenna. The return loss, bandwidth, gain, radiation efficiency, and frequency performance can be controlled through multilevel and space-filling ground-plane design. Also, said ground-plane can be reduced compared to those of antennas with solid ground-planes.

50 Claims, 19 Drawing Sheets

U.S. PATENT DOCUMENTS

| | | | |
|---|---|---|---|
| 6,377,217 | B1 | 4/2002 | Zhu et al. |
| 6,388,620 | B1 | 5/2002 | Bhattacharyya |
| 6,400,330 | B1 | 6/2002 | Maruyama et al. |
| 6,407,710 | B2 | 6/2002 | Keilen et al. |
| 6,462,710 | B1 | 10/2002 | Carson et al. |
| 6,466,176 | B1 | 10/2002 | Maoz et al. |
| 6,717,494 | B2 | 4/2004 | Kikuchi et al. |
| 6,885,880 | B1 | 4/2005 | Ali |
| 6,911,939 | B2 | 6/2005 | Carson et al. |
| 6,940,460 | B2 | 9/2005 | Maoz et al. |
| 7,362,283 | B2 | 4/2008 | Quintero Illera et al. |
| 2001/0033250 | A1 | 10/2001 | Keilen et al. |
| 2002/0177416 | A1 | 11/2002 | Boyle |
| 2004/0058723 | A1 | 3/2004 | Mikkola et al. |
| 2004/0061648 | A1 | 4/2004 | Pros et al. |

FOREIGN PATENT DOCUMENTS

| | | | |
|---|---|---|---|
| EP | 0519508 | A1 | 6/1992 |
| EP | 0548975 | B1 | 6/1993 |
| EP | 0688040 | A2 | 6/1995 |
| EP | 688040 | | 12/1995 |
| EP | 0892459 | A1 | 1/1999 |
| EP | 0932219 | | 7/1999 |
| EP | 1026774 | A2 | 1/2000 |
| EP | 0997974 | | 5/2000 |
| EP | 1148581 | A1 | 6/2000 |
| EP | 1148581 | | 10/2001 |
| EP | 1211750 | A2 | 11/2001 |
| EP | 1 401 050 | | 3/2004 |
| JP | 10-22723 | A1 | 1/1998 |
| JP | 10-32422 | | 2/1998 |
| JP | 10-261914 | | 9/1998 |
| JP | 10261914 | | 9/1998 |
| WO | WO-96/27219 | | 9/1996 |
| WO | 97/06578 | A1 | 2/1997 |
| WO | 9908337 | A1 | 2/1999 |
| WO | 00/52784 | A1 | 9/2000 |
| WO | WO-01/22528 | | 3/2001 |
| WO | WO-01/39321 | | 5/2001 |
| WO | WO-01/54225 | | 7/2001 |
| WO | 0180354 | A1 | 10/2001 |
| WO | 01/89031 | | 11/2001 |
| WO | 01/89031 | A1 | 11/2001 |
| WO | WO-02/29929 | | 4/2002 |
| WO | 02095869 | A1 | 11/2002 |
| WO | WO-03/034544 | | 4/2003 |
| WO | WO-2004/001894 | | 12/2003 |

OTHER PUBLICATIONS

Chih-Yu Huang et al., "Cross-Slot-Coupled Microstrip Antenna and Dielectric Resonator Antenna for Circular Polarization", IEEE vol. 47, No. 4, Apr. 1999 (5 pages).

Jaume Anguera et al., "Enhancing the Performance of Handset Antennas by Means of Goundplane Design", IEEE, 2006, (4 pages).

Manteuffel, Dirk et al., "Investigation on Integrated Antennas for GSM Mobile Phones", IMST GmbH, 4 pages, Abstract only.

Chiou, Tzung-Wem et al., "Designs ofCompact Microstrip Atennas with a Slotted Ground Plane", IEEE Antennas and Propagation Society International Symposium, vol. 2, 2001, pp. 732-735 (abstract only).

Elamaran, A beam-steerer using reconfigurable PGB ground plane, IEEE. MTT-S Int. Microwave Symp. Dig, 2000.

Kim, A novel photonic bandgap structure for low-pass filter of wide stop band, IEEE Microwave and Guided Wave Letters, Jan. 2000, vol. 10, n. 2.

Gschwendtner, Multi-service dual-mode spiral antenna for conformal integration into vehicle roofs, IEEE Antennas and Propagation Society International Symposium, 2000.

Huang, Dielectric resonator antenna on a slotted ground plane, IEEE Antennas and Propagation Society International Symposium and USCN/URSI National Radio Science Meeting, 2001.

Wern, Designs of compact microstrip antennas with a slotted ground plane, IEEE Antennas and Propagation Society International Symposium, 2001.

Horii, Harmonic control by photonic bandgap on microstrip patch antenna, IEEE Microwave and Guided Wave Letters, 1999, vol. 9 No. 1.

Wong, Improved microstrip Sierpinsli carpet antenna, IEEE Proceedings of APMC, 2001.

Lin, A dual-frequency microstrip-line-fed printed slot antenna, Microwave and Optical Technology Letters, Mar. 20, 2001, vol. 26, No. 6.

Huynh, Ground planes effects on PIFA performance, IEEE APS/URSI Conference, Jul. 2000.

Volski, Influence of the shape of the ground plane on the radiation parameters of planar antennas, Proc. of the Millenium AP conference, Apr. 2000.

Natarajan, Effect of ground plane shaoe on microstrip antenna performance for cell.phone applications, IEEE Antennas and Propagation Society International Symposium, 200, vol. 3.

Moretti, P. Numerical investigation of vertical contacless transitions for multilayer RF circuits, Microwave Symposium Digest, 2001 IEEE MTT-S International, 2001.

Puente Baliarda, C. Fractal antennas. Tesi Doctoral, PhD thesis, Universitat Politecnica de Catalunya, May 1997.

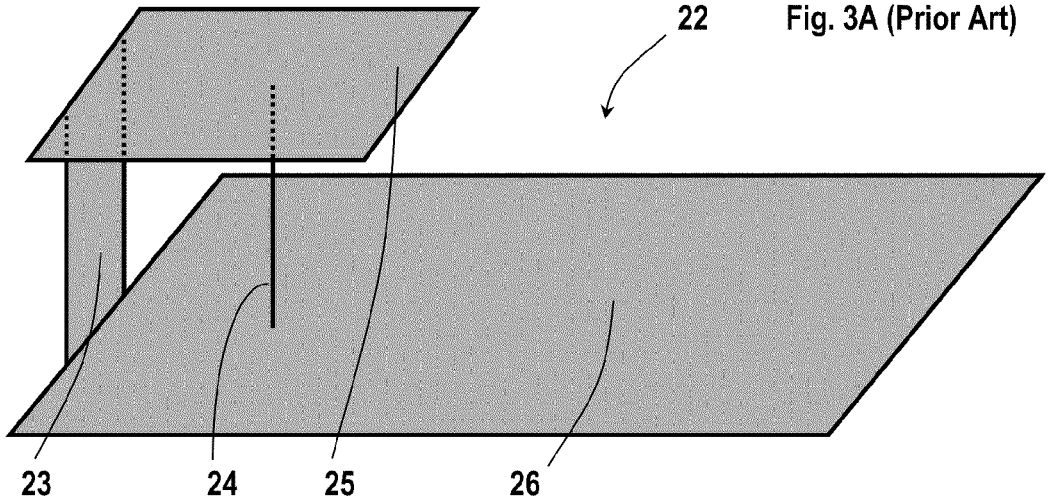
Fig. 3A (Prior Art)
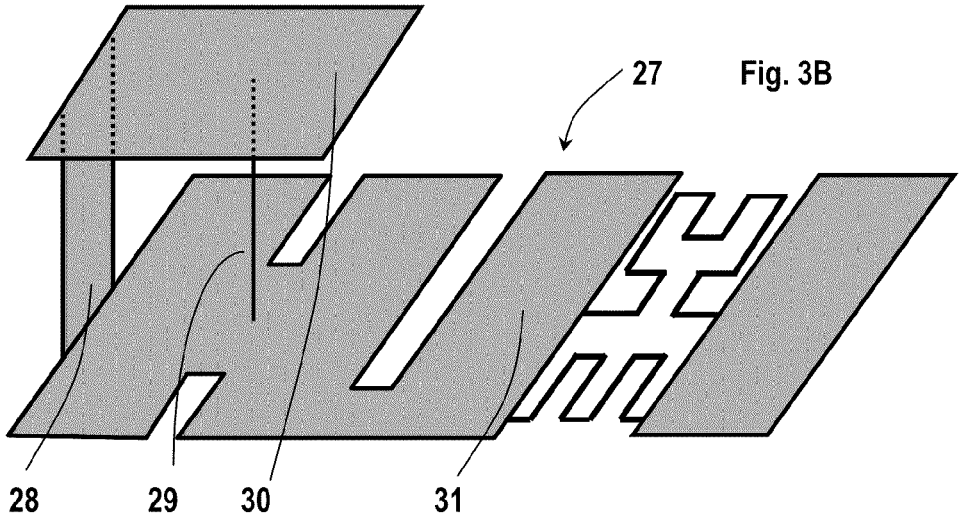
Fig. 3B
Fig. 3

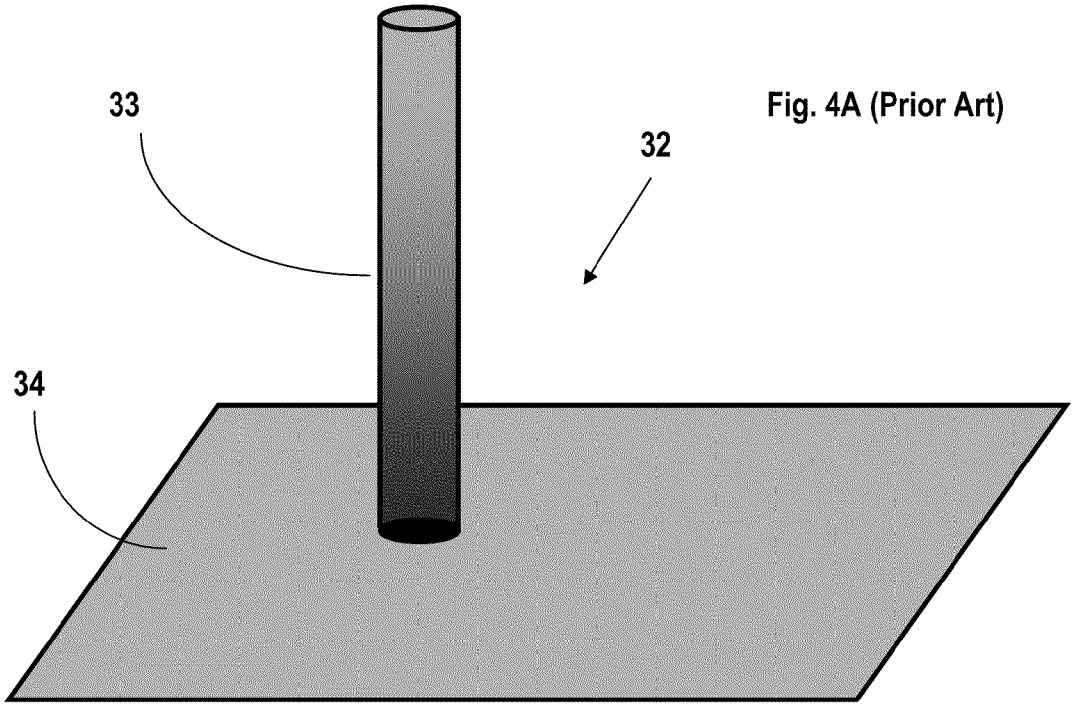
Fig. 4A (Prior Art)
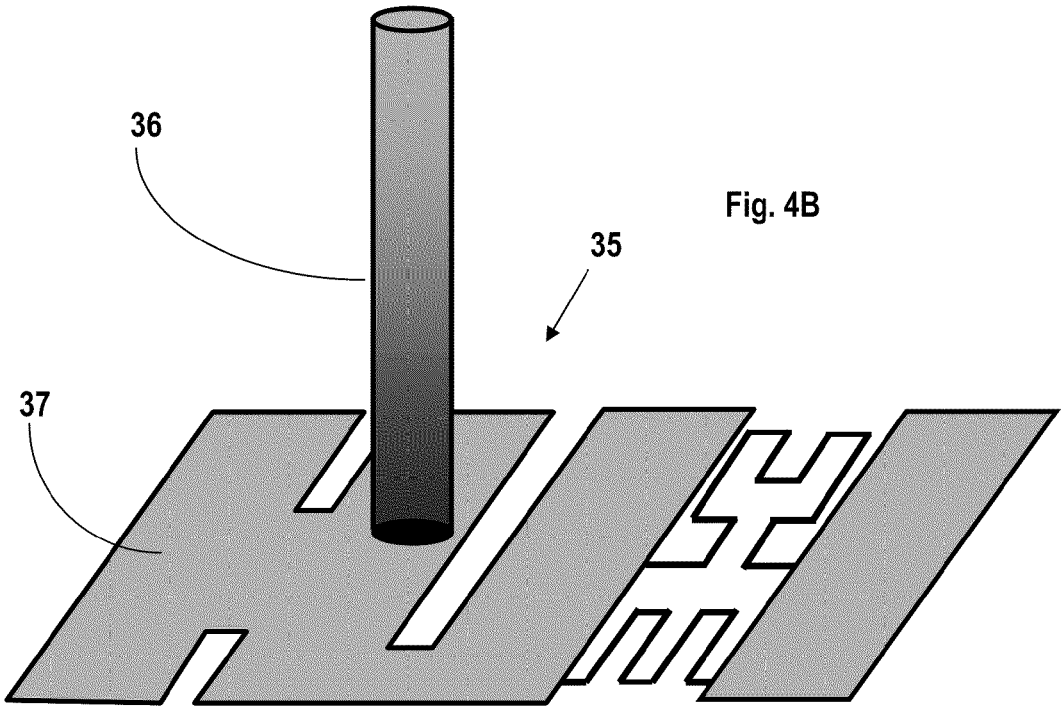
Fig. 4B
Fig. 4

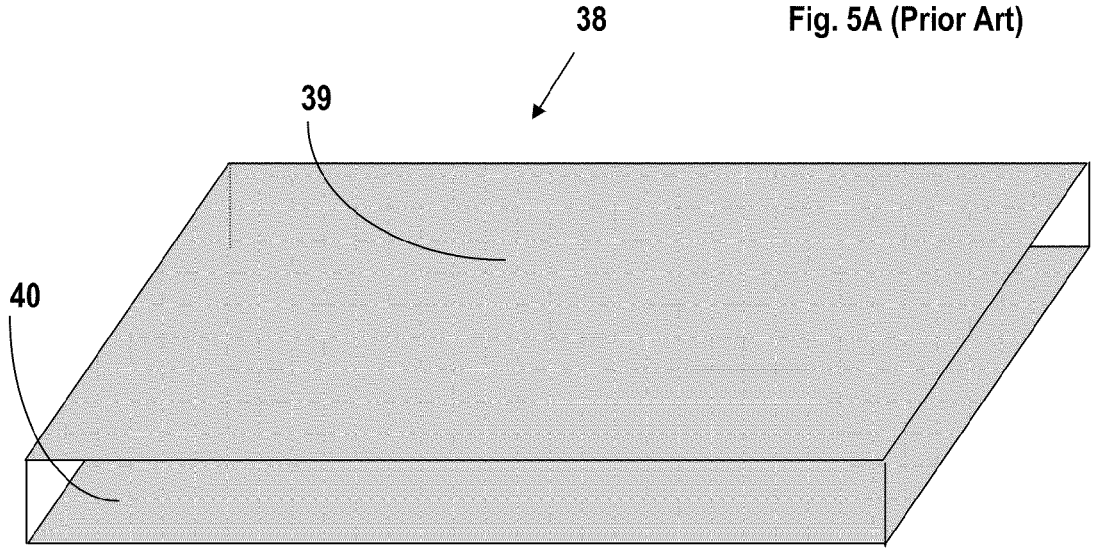
Fig. 5A (Prior Art)
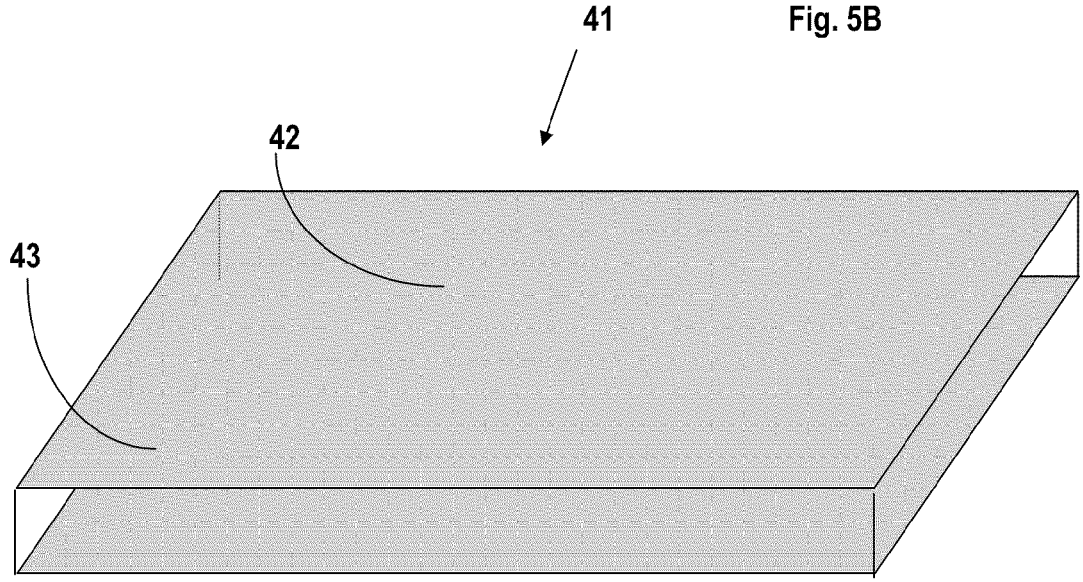
Fig. 5B
Fig. 5

MULTILEVEL AND SPACE-FILLING GROUND-PLANES FOR MINIATURE AND MULTIBAND ANTENNAS

CROSS-REFERENCE TO RELATED APPLICATIONS

This application is a continuation of U.S. patent application Ser. No. 12/033,446, filed on Feb. 19, 2008 now U.S. Pat. No. 7,688,276. U.S. patent application Ser. No. 12/033,446 is a continuation of Ser. No. 10/797,732, filed Mar. 10, 2004, now U.S. Pat. No. 7,362,283, issued on Apr. 22, 2008. Ser. No. 10/797,732 is a continuation of PCT/EP01/10589, filed on Sep. 13, 2001. U.S. patent application Ser. No. 12/033,446, U.S. Pat. No. 7,362,283 and International Patent Application PCT/EP01/10589 are incorporated herein by reference.

OBJECT AND BACKGROUND OF THE INVENTION

1. Technical Field of the Invention

The present invention relates generally to a new family of antenna ground-planes of reduced size and enhanced performance based on an innovative set of geometries. These new geometries are known as multilevel and space-filling structures, which had been previously used in the design of multiband and miniature antennas. A throughout description of such multilevel or space-filling structures can be found in "Multilevel Antennas" (Patent Publication No. WO01/22528) and "Space-Filling Miniature Antennas" (Patent Publication No. WO01/54225).

2. Description of the Related Art

The current invention relates to the use of such geometries in the ground-plane of miniature and multiband antennas. In many applications, such as for instance mobile terminals and handheld devices, it is well known that the size of the device restricts the size of the antenna and its ground-plane, which has a major effect on the overall antenna performance. In general terms, the bandwidth and efficiency of the antenna are affected by the overall size, geometry, and dimensions of the antenna and the ground-plane. A report on the influence of the ground-plane size in the bandwidth of terminal antennas can be found in the publication "Investigation on Integrated Antennas for GSM Mobile Phones", by D. Manteuffel, A. Bahr, I. Wolff, Millennium Conference on Antennas & Propagation, ESA, AP2000, Davos, Switzerland, April 2000. In the prior art, most of the effort in the design of antennas including ground-planes (for instance microstrip, planar inverted-F or monopole antennas) has been oriented to the design of the radiating element (that is, the microstrip patch, the PIFA element, or the monopole arm for the examples described above), yet providing a ground-plane with a size and geometry that were mainly dictated by the size or aesthetics criteria according to every particular application.

One of the key issues of the present invention is considering the ground-plane of an antenna as an integral part of the antenna that mainly contributes to its radiation and impedance performance (impedance level, resonant frequency, bandwidth). A new set of geometries are disclosed here, such a set allowing to adapt the geometry and size of the ground-plane to the ones required by any application (base station antennas, handheld terminals, cars, and other motor-vehicles and so on), yet improving the performance in terms of, for instance, bandwidth, Voltage Standing Wave Ratio (hereafter VSWR), or multiband behaviour.

The use of multilevel and space-filling structures to enhance the frequency range an antenna can work within was well described in patent publication numbers WO01/22528 and WO01/54225. Such an increased range is obtained either through an enhancement of the antenna bandwidth, with an increase in the number of frequency bands, or with a combination of both effects. In the present invention, said multilevel and space-filling structures are advantageously used in the ground-plane of the antenna obtaining this way either a better return loss or VSWR, a better bandwidth, a multiband behaviour, or a combination of all these effects. The technique can be seen as well as a means of reducing the size of the ground-plane and therefore the size of the overall antenna.

A first attempt to improve the bandwidth of microstrip antennas using the ground-plane was described by T. Chiou, K. Wong, "Designs of Compact Microstrip Antennas with a Slotted Ground Plane". IEEE-APS Symposium, Boston, 8-12 Jul., 2001. The skilled in the art will notice that even though the authors claim the improved performance is obtained by means of some slots on the antenna ground-plane, those were unintentionally using a very simple case of multilevel structure to modify the resonating properties of said ground-plane. In particular, a set of two rectangles connected through three contact points and a set of four rectangles connected through five contact points were described there. Another example of an unintentional use of a multilevel ground structure in an antenna ground-plane is described in U.S. Pat. No. 5,703,600. There, a particular case of a ground-plane composed by three rectangles with a capacitive electromagnetic coupling between them was used. It should be stressed that neither in the paper by Chiou and Wong, nor in U.S. Pat. No. 5,703,600, the general configuration for space-filling or multilevel structures were disclosed or claimed, so the authors were not attempting to use the benefits of said multilevel or space-filling structures to improve the antenna behaviour.

Some of the geometries described in the present invention are inspired in the geometries already studied in the 19.sup.th century by several mathematicians such as Giusepe Peano and David Hilbert. In all said cases the curves were studied from the mathematical point of view but were never used for any practical engineering application. Such mathematical abstractions can be approached in a practical design by means of the general space-filling curves described in the present invention. Other geometries, such as the so called SZ, ZZ, HilbertZZ, Peanoinc, Peanodec or PeanoZZ curves described in patent publication WO01/54225 are included in the set of space-filling curves used in an innovative way in the present invention. It is interesting to notice that in some cases, such space-filling curves can be used to approach ideal fractal shapes as well.

The dimension (D) is often used to characterize highly complex geometrical curves and structures such as those described in the present invention. There exists many different mathematical definitions of dimension but in the present document the box-counting dimension (which is well-known to those skilled in mathematics theory) is used to characterize a family of designs. Again, the advantage of using such curves in the novel configuration disclosed in the present invention is mainly the overall antenna miniaturization together with and enhancement of its bandwidth, impedance, or multiband behaviour.

Although usually not as efficient as the general space-filling curves disclosed in the present invention, other well-known geometries such as meandering and zigzag curves can also be used in a novel configuration according to the spirit and scope of the present invention. Some descriptions of using zigzag or meandering curves in antennas can be found for instance in patent publication WO96/27219, but it should be noticed that in the prior-art such geometries were used mainly in the design of the radiating element rather than in the design of the ground-plane as it is the purpose and basis of several embodiments in the present invention.

It is known the European Patent EP-688.040 which discloses a bidirectional antenna including a substrate having a first and second surfaces. On a second surface are arranged respectively, a ground conductor formed by a single surface, a strip conductor and a patch conductor.

SUMMARY OF THE INVENTION

The key point of the present invention is shaping the ground-plane of an antenna in such a way that the combined effect of the ground-plane and the radiating element enhances the performance and characteristics of the whole antenna device, either in terms of bandwidth, VSWR, multiband behaviour, efficiency, size, or gain. Instead of using the conventional solid geometry for ground-planes as commonly described in the prior art, the invention disclosed here introduces a new set of geometries that forces the currents on the ground-plane to flow and radiate in a way that enhances the whole antenna behaviour.

The basis of the invention consists of breaking the solid surface of a conventional ground-plane into a number of conducting surfaces (at least two of them) said surfaces being electromagnetically coupled either by the capacitive effect between the edges of the several conducting surfaces, or by a direct contact provided by a conducting strip, or a combination of both effects.

The resulting geometry is no longer a solid, conventional ground-plane, but a ground-plane with a multilevel or space-filling geometry, at least in a portion of said ground-plane.

A Multilevel geometry for a ground-plane consists of a conducting structure including a set of polygons, all of said polygons featuring the same number of sides, wherein said polygons are electromagnetically coupled either by means of a capacitive coupling or ohmic contact, wherein the contact region between directly connected polygons is narrower than 50% of the perimeter of said polygons in at least 75% of said polygons defining said conducting ground-plane. In this definition of multilevel geometry, circles and ellipses are included as well, since they can be understood as polygons with infinite number of sides.

On the other hand, an Space-Filling Curve (hereafter SFC) is a curve that is large in terms of physical length but small in terms of the area in which the curve can be included. More precisely, the following definition is taken in this document for a space-filling curve: a curve composed by at least ten segments which are connected in such a way that each segment forms an angle with their neighbours, that is, no pair of adjacent segments define a larger straight segment, and wherein the curve can be optionally periodic along a fixed straight direction of space if, and only if, the period is defined by a non-periodic curve composed by at least ten connected segments and no pair of said adjacent and connected segments defines a straight longer segment. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the ground-plane according to the present invention, the segments of the SFC curves included in said ground-plane must be shorter than a tenth of the free-space operating wavelength.

Depending on the shaping procedure and curve geometry, some infinite length SFC can be theoretically designed to feature a Haussdorf dimension larger than their topological-dimension. That is, in terms of the classical Euclidean geometry, it is usually understood that a curve is always a one-dimension object; however when the curve is highly convoluted and its physical length is very large, the curve tends to fill parts of the surface which supports it; in that case, the Haussdorf dimension can be computed over the curve (or at least an approximation of it by means of the box-counting algorithm) resulting in a number larger than unity. The curves described in FIG. 2 are some examples of such SFC; in particular, drawings 11, 13, 14, and 18 show some examples of SFC curves that approach an ideal infinite curve featuring a dimension D=2. As known by those skilled in the art, the box-counting dimension can be computed as the slope of the straight portion of a log-log graph, wherein such a straight portion is substantially defined as a straight segment. For the particular case of the present invention, said straight segment will cover at least an octave of scales on the horizontal axis of the log-log graph.

Depending on the application, there are several ways for establishing the required multilevel and space-filling metallic pattern according to the present invention. Due to the special geometry of said multilevel and space-filling structures, the current distributes over the ground-plane in such a way that it enhances the antenna performance and features in terms of:

(a) Reduced size compared to antennas with a solid ground-plane.
(b) Enhanced bandwidth compared to antennas with a solid ground-plane.
(c) Multifrequency performance.
(d) Better VSWR feature at the operating band or bands.
(e) Better radiation efficiency.
(f) Enhanced gain.

It will be clear that any of the general and newly described ground-planes of the present invention can be advantageously used in any of the prior-art antenna configurations that require a ground-plane, for instance: antennas for handheld terminals (cellular or cordless telephones, PDAs, electronic pagers, electronic games, or remote controls), base station antennas (for instance for coverage in micro-cells or pico-cells for systems such as AMPS, GSM900, GSM1800, UMTS, PCS1900, DCS, DECT, WLAN, . . . ), car antennas, and so on. Such antennas can usually take the form of microstrip patch antennas, slot-antennas, Planar Inverted-F (PIFA) antennas, monopoles and so on, and in all those cases where the antenna requires a ground-plane, the present invention can be used in an advantageous way. Therefore, the invention is not limited to the aforementioned antennas. The antenna could be of any other type as long as a ground-plane is included.

BRIEF DESCRIPTION OF THE DRAWINGS

For a better understanding of the present invention, reference will now be made to the appended drawings in which:

FIG. 3A shows a perspective view of a conventional (prior-art) Planar Inverted-F Antenna or PIFA (22) formed by a radiating antenna element 25, a conventional solid surface ground-plane 26, a feed point 24 coupled somewhere on the patch 25 depending upon the desired input impedance, and a short-circuit 23 coupling the patch element 25 to the ground-plane 26. FIG. 3B shows a new configuration (27) for a PIFA antenna, formed by an antenna element 30, a feed point 29, a short-circuit 28, and a particular example of a new ground-plane structure 31 formed by both multilevel and space-filling geometries.

FIG. 4A is a representational perspective view of the conventional configuration (prior-art) for a monopole 33 over a solid surface ground-plane 34. FIG. 4B shows an improved monopole antenna configuration 35 where the ground-plane 37 is composed by multilevel and space-filling structures.

FIG. 5A shows a perspective view of a patch antenna system 38 (prior-art) formed by a rectangular radiating element patch 39 and a conventional ground-plane 40. FIG. 5B shows an improved antenna patch system composed by a radiating element 42 and a multilevel and space-filling ground-plane 43.

DETAILED DESCRIPTION OF THE PREFERRED EMBODIMENTS

Figure 1:
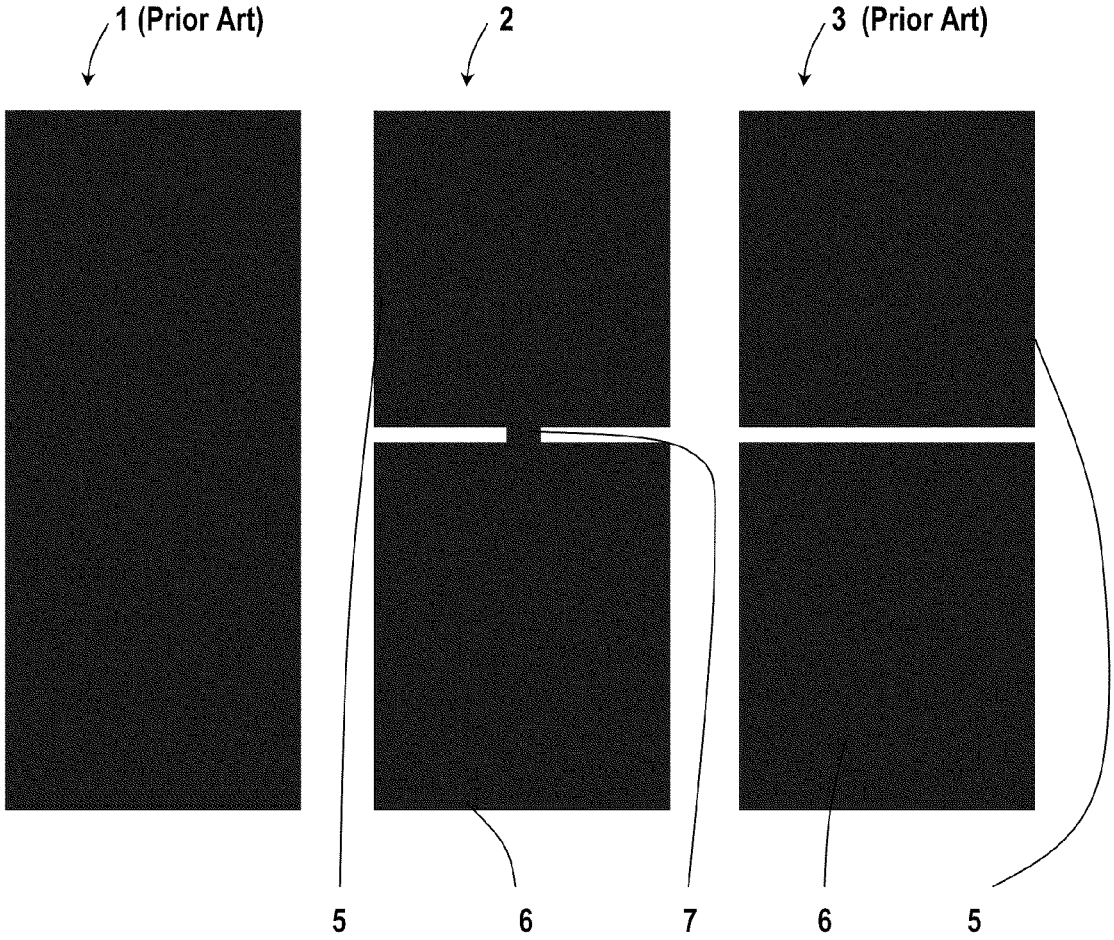
FIG. 1 shows a comparison between two prior art ground-planes and a new multilevel ground-plane. Drawing 1 shows a conventional ground-plane formed by only one solid surface (rectangle, prior-art), whereas drawing 2 shows a particular case of ground-plane that has been broken in two surfaces 5 and 6 (rectangles) connected by a conducting strip 7, according to the general techniques disclosed in the present invention. Drawing 3 shows a ground-plane where the two conducting surfaces 5 and 6, separated by a gap 4, are being connected through capacitive effect (prior-art).
Figure 2:
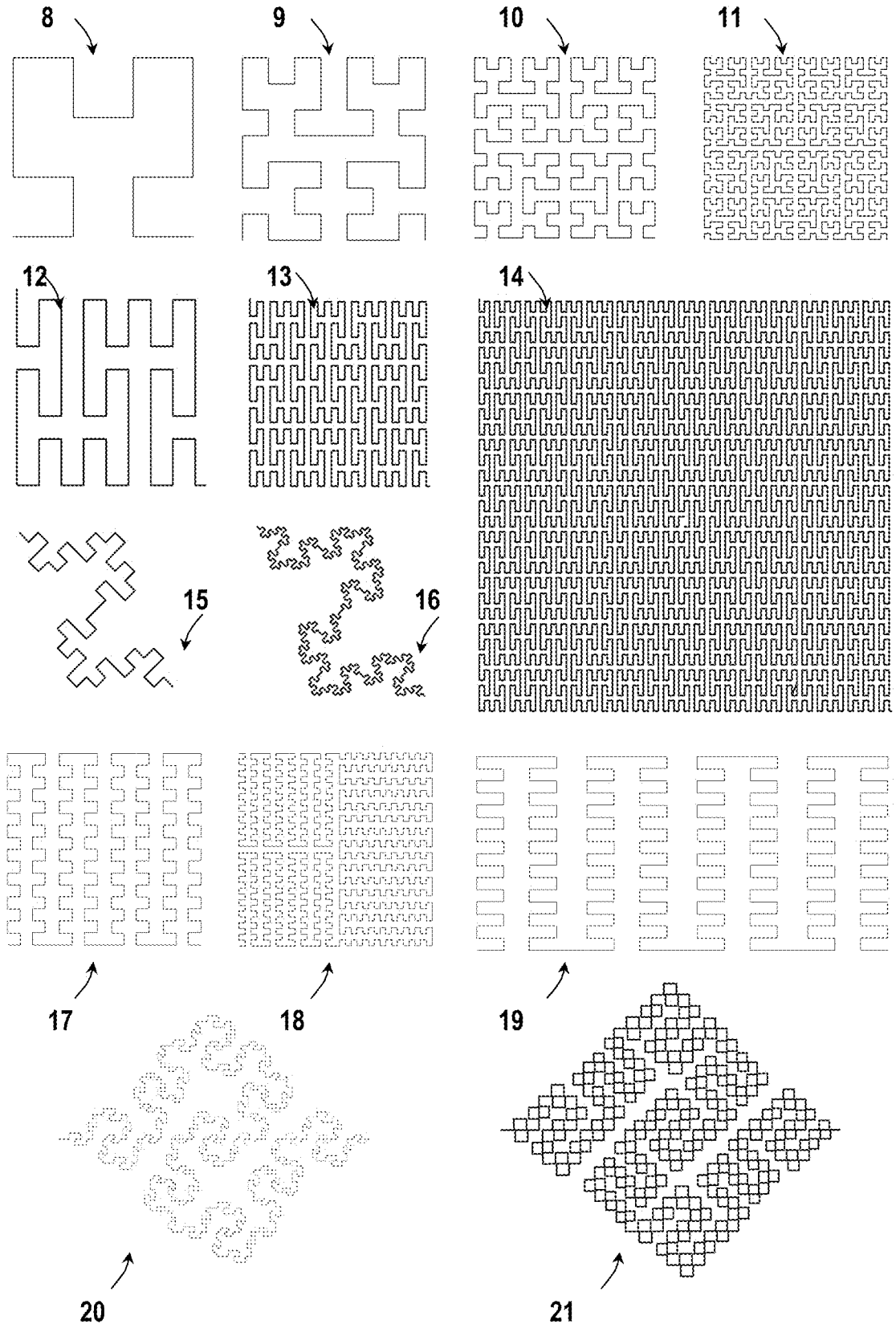
FIG. 2 shows some examples of SFC curves. From an initial curve 8, other curves 9, 10, and 11 are formed (called Hilbert curves). Likewise, other set of SFC curves can be formed, such as set 12, 13, and 14 (called SZ curves); set 15 and 16 (known as ZZ curves); set 17, 18, and 19 (called HilbertZZ curves); set 20 (Peanodec curve); and set 21 (based on the Giusepe Peano curve).

In order to construct an antenna assembly according to embodiments of our invention, a suitable antenna design is required. Any number of possible configurations exists, and the actual choice of antenna is dependent, for instance, on the operating frequency and bandwidth, among other antenna parameters. Several possible examples of embodiments are listed hereinafter. However, in view of the foregoing description it will be evident to a person skilled in the art that various modifications may be made within the scope of the invention. In particular, different materials and fabrication processes for producing the antenna system may be selected, which still achieve the desired effects. Also, it would be clear that other multilevel and space-filling geometries could be used within the spirit of the present invention.

FIG. 3A shows in a manner already known in prior art a Planar Inverted-F (22) Antenna (hereinafter PIFA Antenna) being composed by a radiating antenna element 25, a conventional solid surface ground-plane 26, a feed point 24 coupled somewhere on the patch 25 depending upon the desired input impedance, and a short-circuit 23 coupling the patch element 25 to the ground-plane 26. The feed point 24 can be implemented in several ways, such a coaxial cable, the sheath of which is coupled to the ground-plane and the inner conductor 24 of which is coupled to the radiating conductive element 25. The radiating conductive element 25 is usually shaped like a quadrangle, but several other shapes can be found in other patents or scientific articles. Shape and dimensions of radiating element 25 will contribute in determining operating frequency of the overall antenna system. Although usually not considered as a part of the design, the ground-plane size and geometry also has an effect in determining the operating frequency and bandwidth for said PIFA. PIFA antennas have become a hot topic lately due to having a form that can be integrated into the per se known type of handset cabinets.

Unlike the prior art PIFA ground-planes illustrated in FIG. 3A, the newly disclosed ground-plane 31 according to FIG. 3B is composed by multilevel and space-filling structures obtaining this way a better return loss or VSWR, a better bandwidth, and multiband behaviour, along with a compressed antenna size (including ground-plane). The particular embodiment of PIFA 27 is composed by a radiating antenna element 30, a multilevel and space-filling ground-plane 31, a feed point 29 coupled somewhere on the patch 30, and a short-circuit 28 coupling the patch element 30 to the ground-plane 31. For the sake of clarity but without loss of generality, a particular case of multilevel ground-plane 31 is showed, where several quadrangular surfaces are being electromagnetically coupled by means of direct contact through conducting strips and said polygons, together with an SFC and a meandering line. More precisely, the multilevel structure is formed with 5 rectangles, said multilevel structure being connected to a rectangular surface by means of SFC (8) and a meandering line with two periods. It is clear to those skilled in the art that those surfaces could have been any other type of polygons with any size, and being connected in any other manner such as any other SFC curve or even by capacitive effect. For the sake of clarity, the resulting surfaces defining said ground-plane are lying on a common flat surface, but other conformal configurations upon curved or bent surfaces could have been used as well.

Figure 6:
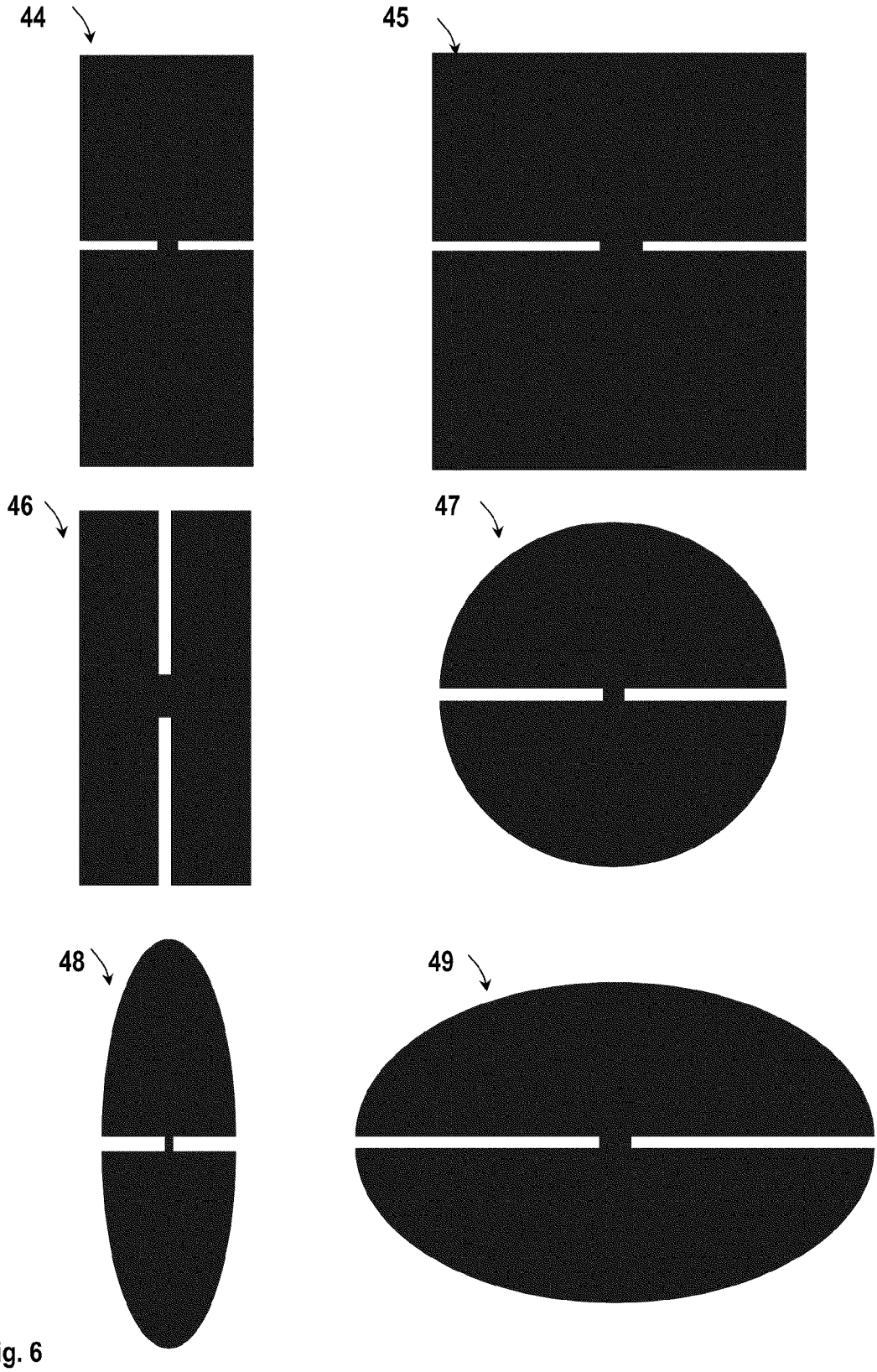
FIG. 6 shows several examples of different contour shapes for multilevel ground-planes, such as rectangular (44, 45, and 46) and circular (47, 48, and 49). In this case, circles and ellipses are taken as polygons with infinite number of sides.

For this preferred embodiment, the edges between coupled rectangles are either parallel or orthogonal, but they do not need to be so. Also, to provide the ohmic contact between polygons several conducting strips can be used according to the present invention. The position of said strips connecting the several polygons can be placed at the center of the gaps as in FIG. 6 and drawings 2, 50, 51, 56, 57, 62, 65, or distributed along several positions as shown in other cases such as for instance drawings 52 or 58.

Figure 7:
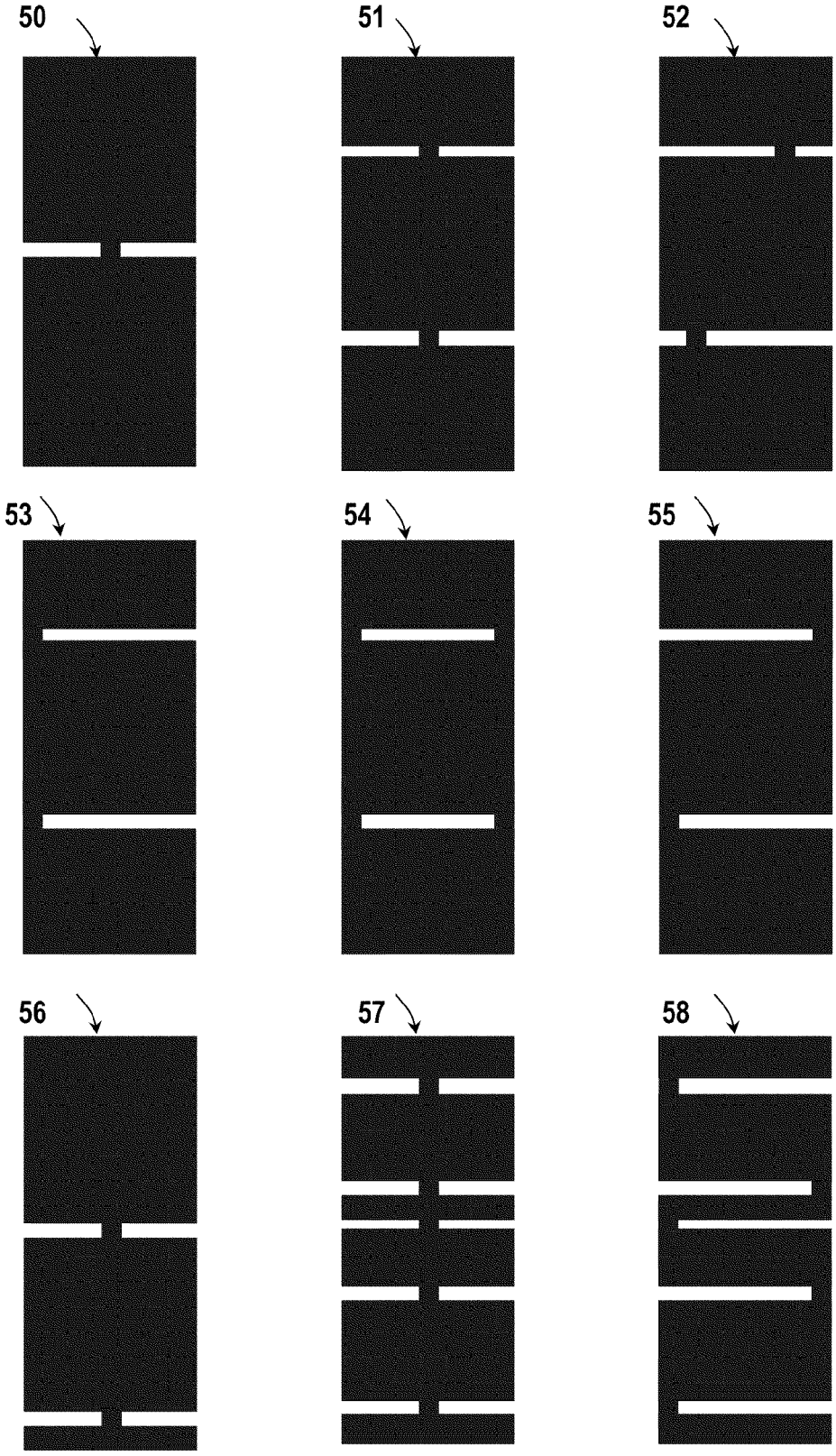
FIG. 7 shows a series of same-width multilevel structures (in this case rectangles), where conducting surfaces are being connected by means of conducting strips (one or two) that are either aligned or not aligned along a straight axis.
Figure 8:
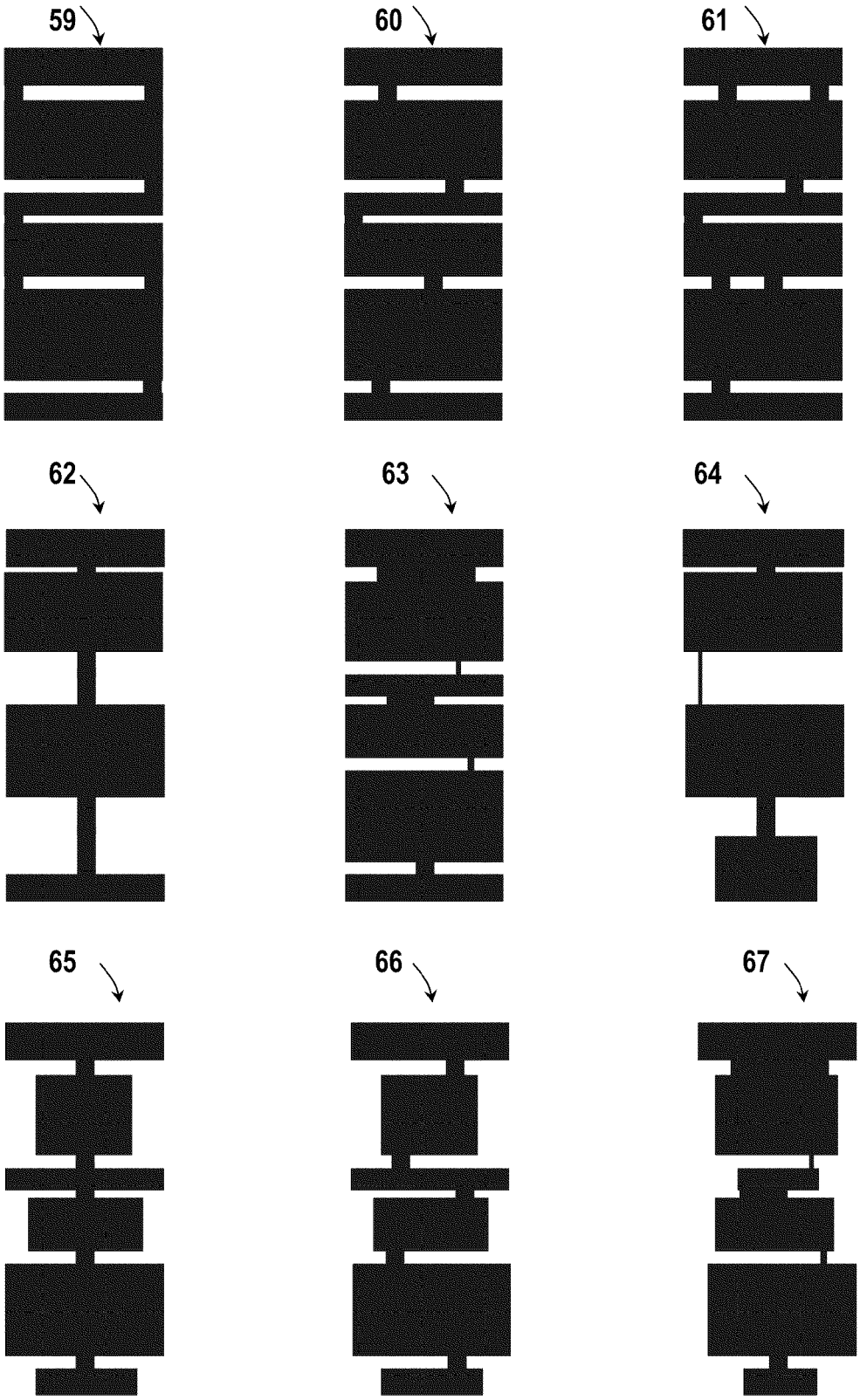
FIG. 8 shows that not only same-width structures can be connected via conducting strips. More than one conducting strips can be used to interconnect rectangular polygons as in drawings 59 and 61. Also it is disclosed some examples of how different width and length conducting strips among surfaces can be used within the spirit of the present invention.
Figure 9:
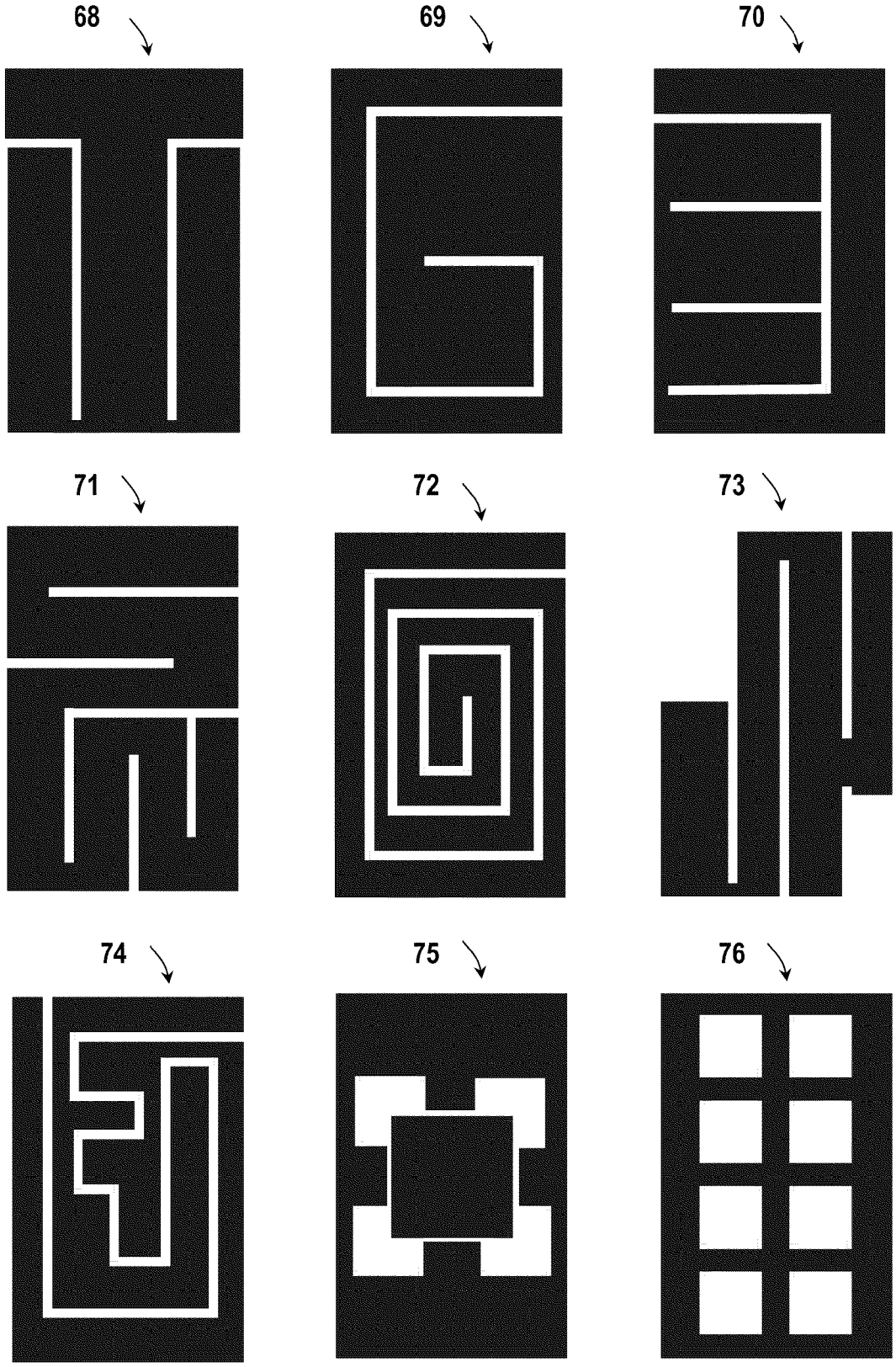
FIG. 9 shows alternative schemes of multilevel ground-planes. The ones being showed in the FIGS. 68 to 76) are being formed from rectangular structures, but any other shape could have been used.
Figure 10:
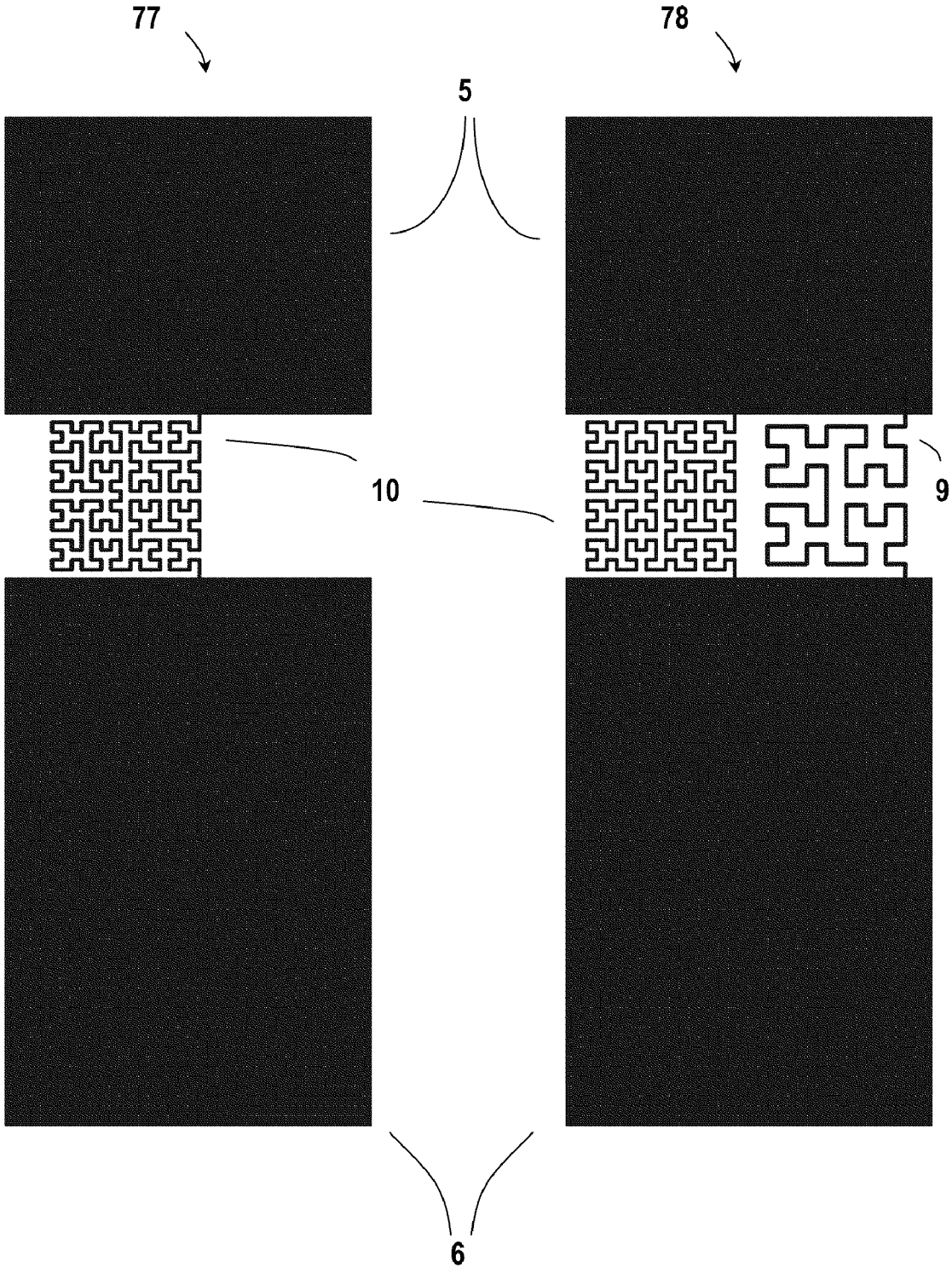
FIG. 10 shows examples (77 and 78) of two conducting surfaces (5 and 6) being connected by one (10) or two (9 and 10) SFC connecting strips.
Figure 11:
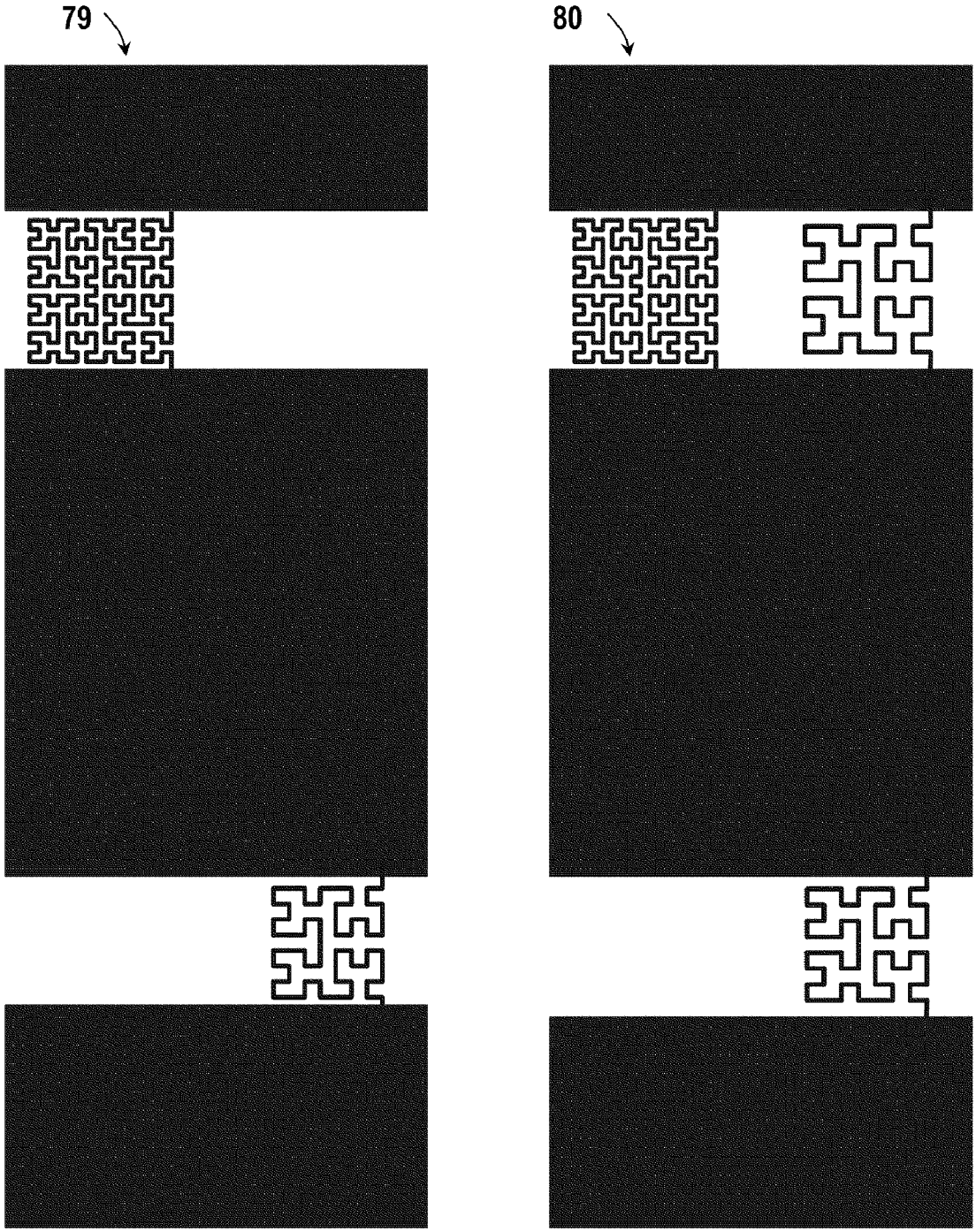
FIG. 11 shows examples wherein at least a portion of the gap between at least two conducting surfaces is shaped as an SPC connecting strip.

In some preferred embodiments, larger rectangles have the same width (for instance FIG. 1 and FIG. 7) but in other preferred embodiments they do not (see for instance drawings 64 through 67 in FIG. 8). Polygons and/or strips are linearly arranged with respect an straight axis (see for instance 56 and 57) in some embodiments while in others embodiments they are not centered with respect to said axis. Said strips can also be placed at the edges of the overall ground-plane as in, for instance, drawing 55, and they can even become arranged in a zigzag or meandering pattern as in drawing 58 where the strips are alternatively and sequentially placed at the two longer edges of the overall ground-plane.

Some embodiments like 59 and 61, where several conducting surfaces are coupled by means of more than one strip or conducting polygon, are preferred when a multiband or broadband behaviour is to be enhanced. Said multiple strip arrangement allows multiple resonant frequencies which can be used as separate bands or as a broad-band if they are properly coupled together. Also, said multiband or broadband behaviour can be obtained by shaping said strips with different lengths within the same gap.

Figure 12:
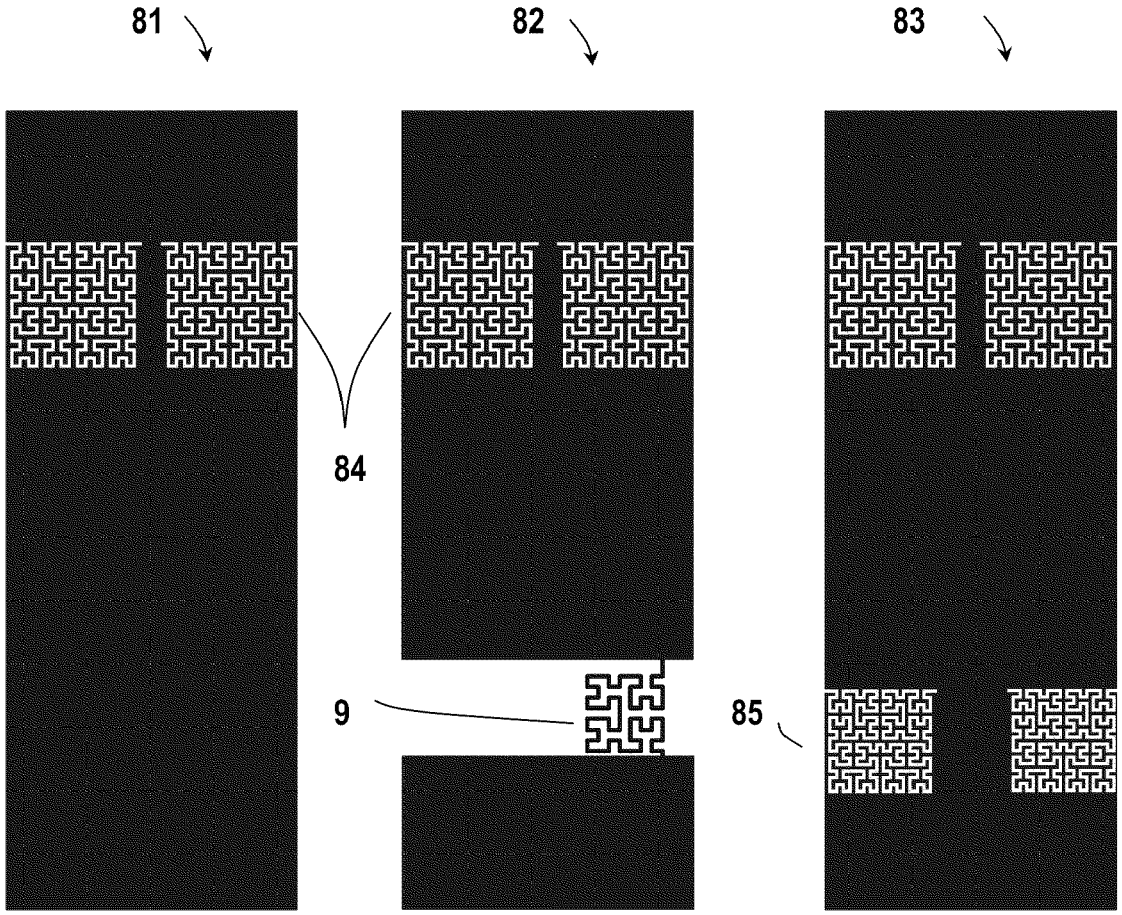
FIG. 12 shows a series of ground-planes where at least one of the parts of said ground-planes is shaped as SFC. In particular, the gaps (84, 85) between conducting surfaces are shaped in some cases as SFC.
Figure 13:
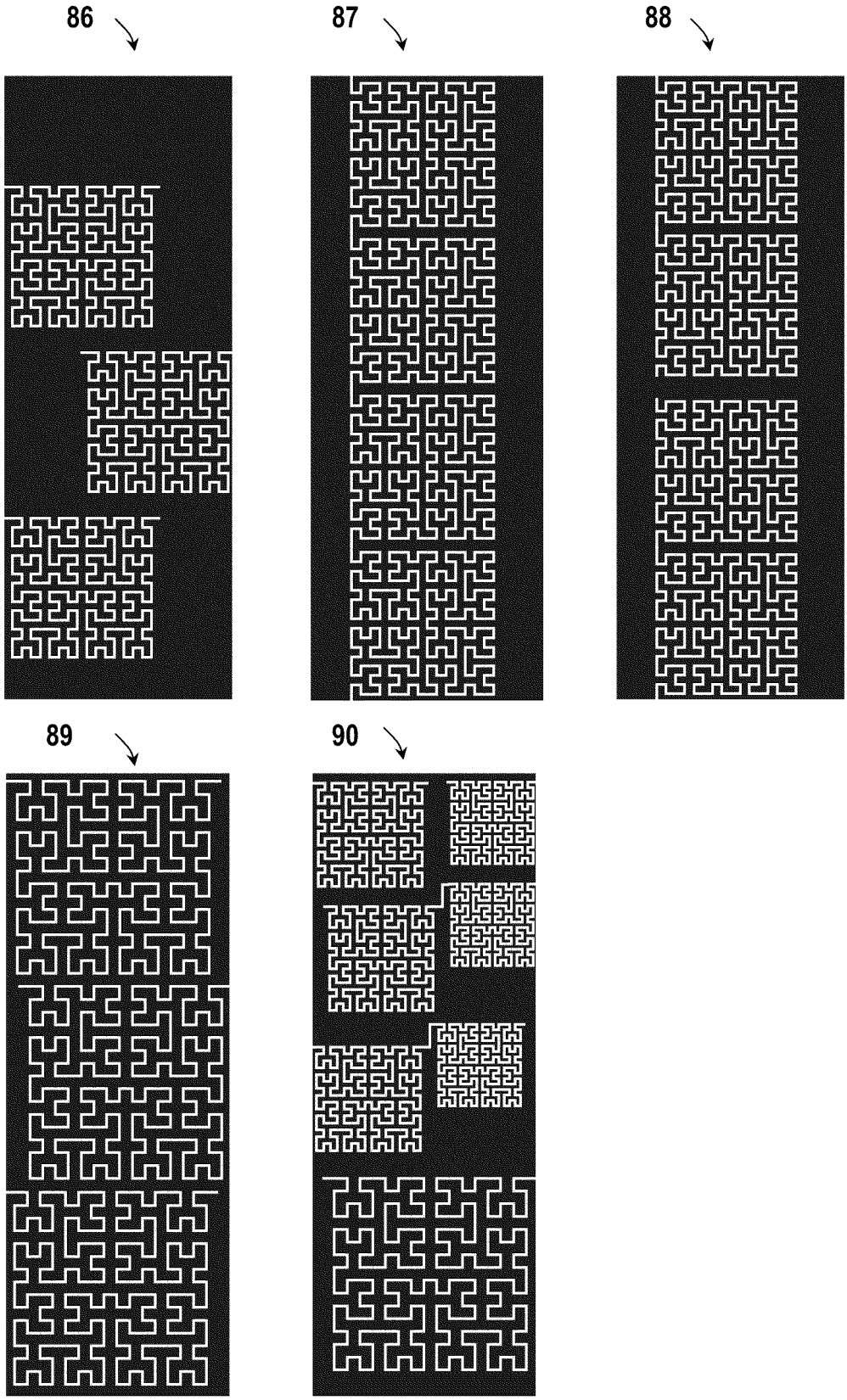
FIG. 13 shows another set of examples where parts of the ground-planes such as the gaps between conducting surfaces are being shaped as SFC.
Figure 14:
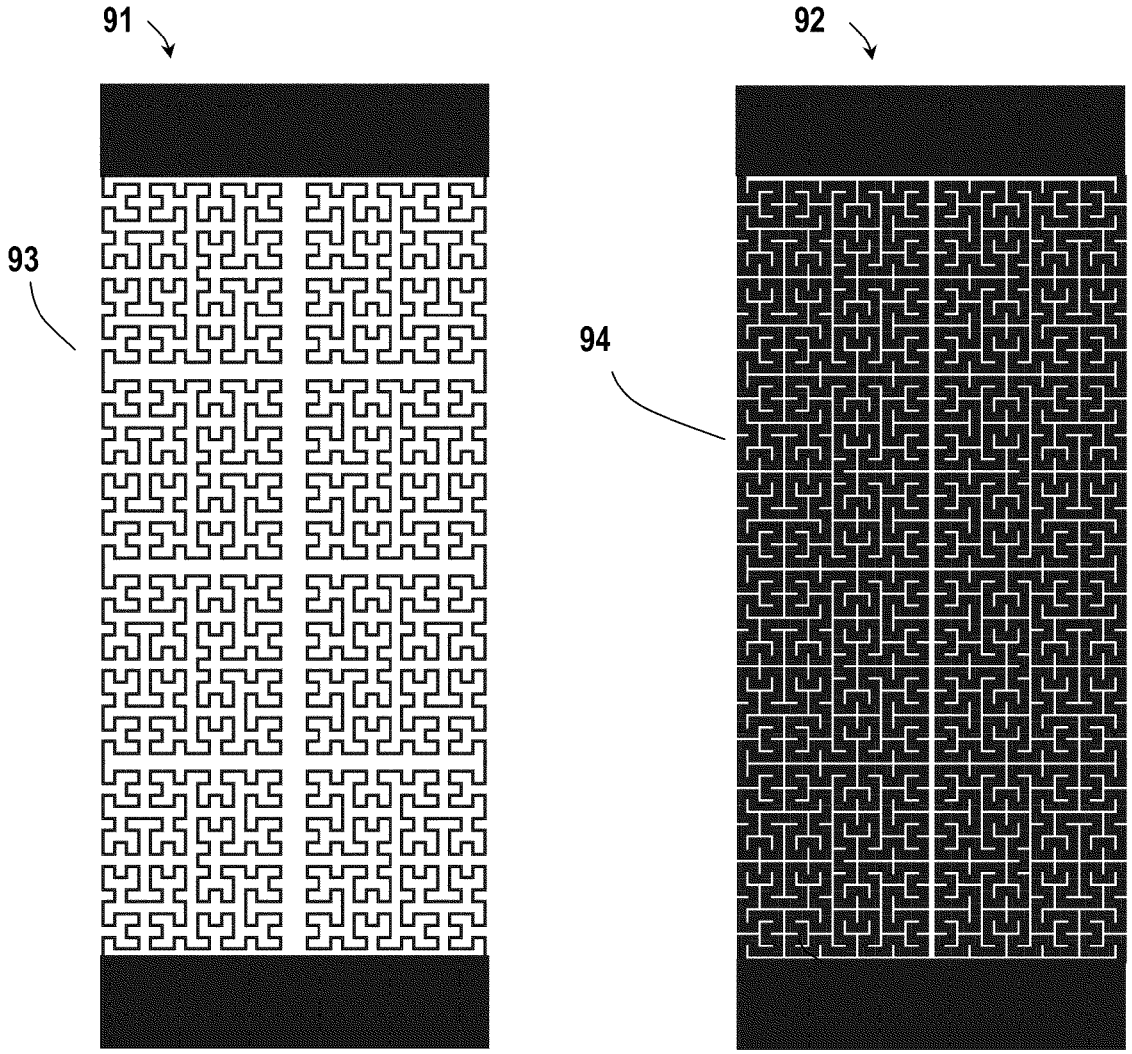
FIG. 14 shows more schemes of ground-planes (91 and 92) with different SFC width curves (93 and 94). Depending on the application, configuration 91 can be used to minimize the size of the antenna while configuration 92 is preferred for enhancing bandwidth in a reduced size antenna while reducing the backward radiation.
Figure 15:
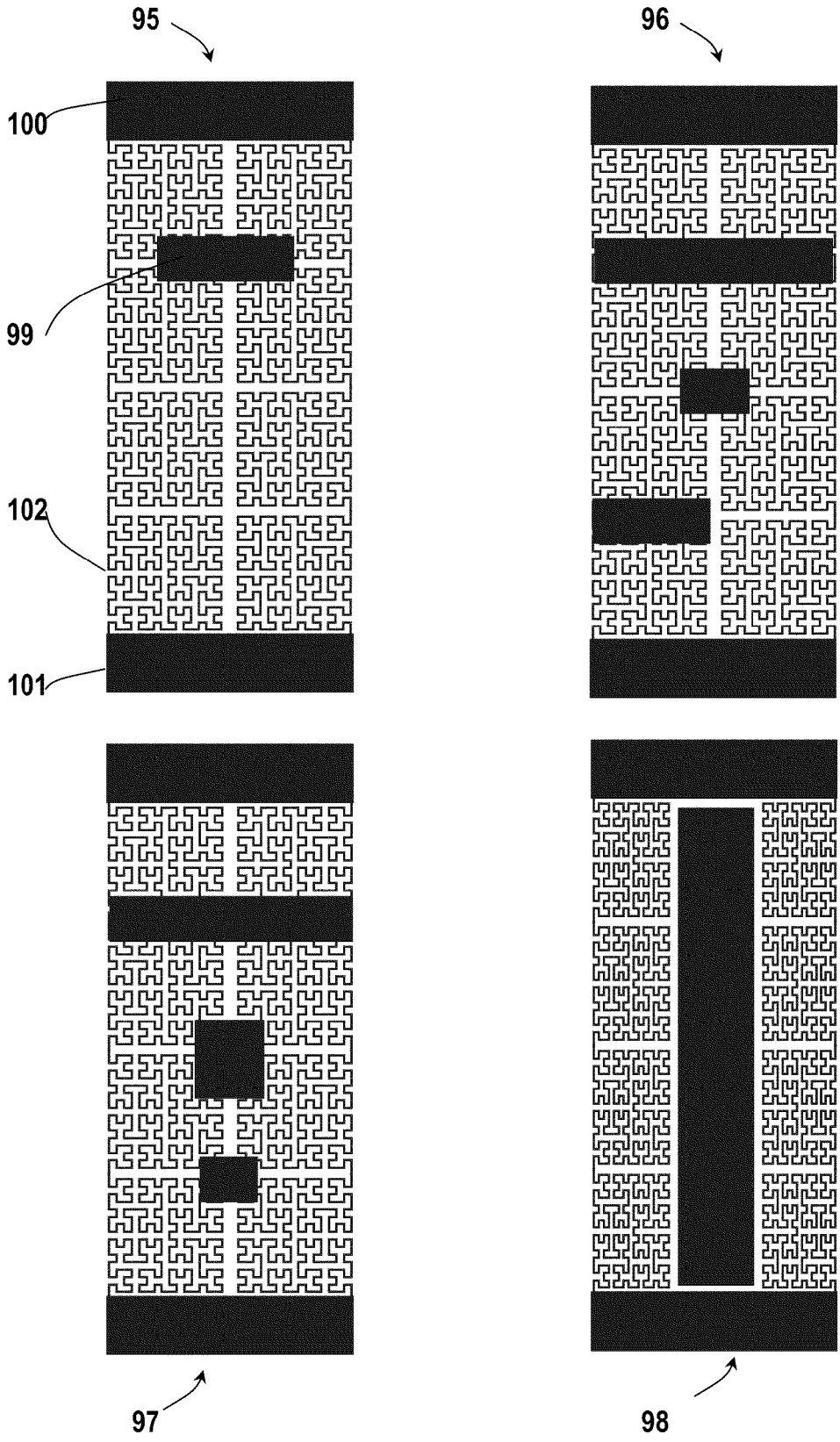
FIG. 15 shows a series of conducting surfaces with different widths being connected through SFC conducting strips either by direct contact (95, 96, 97, 98) or by capacitive effect (central strip in 98).
Figure 16:
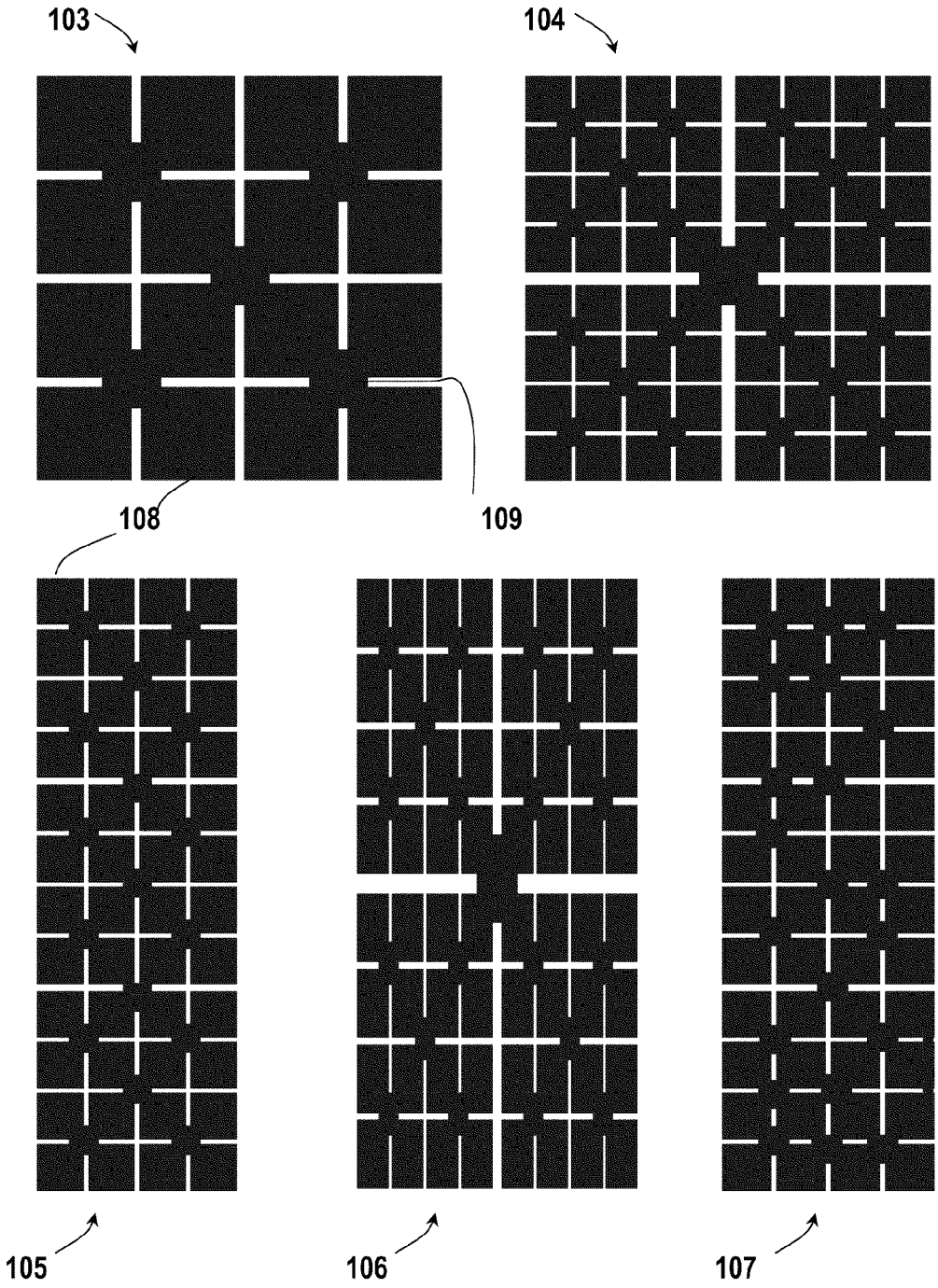
FIG. 16 shows examples of multilevel ground-planes (in this case formed by rectangles).
Figure 17:
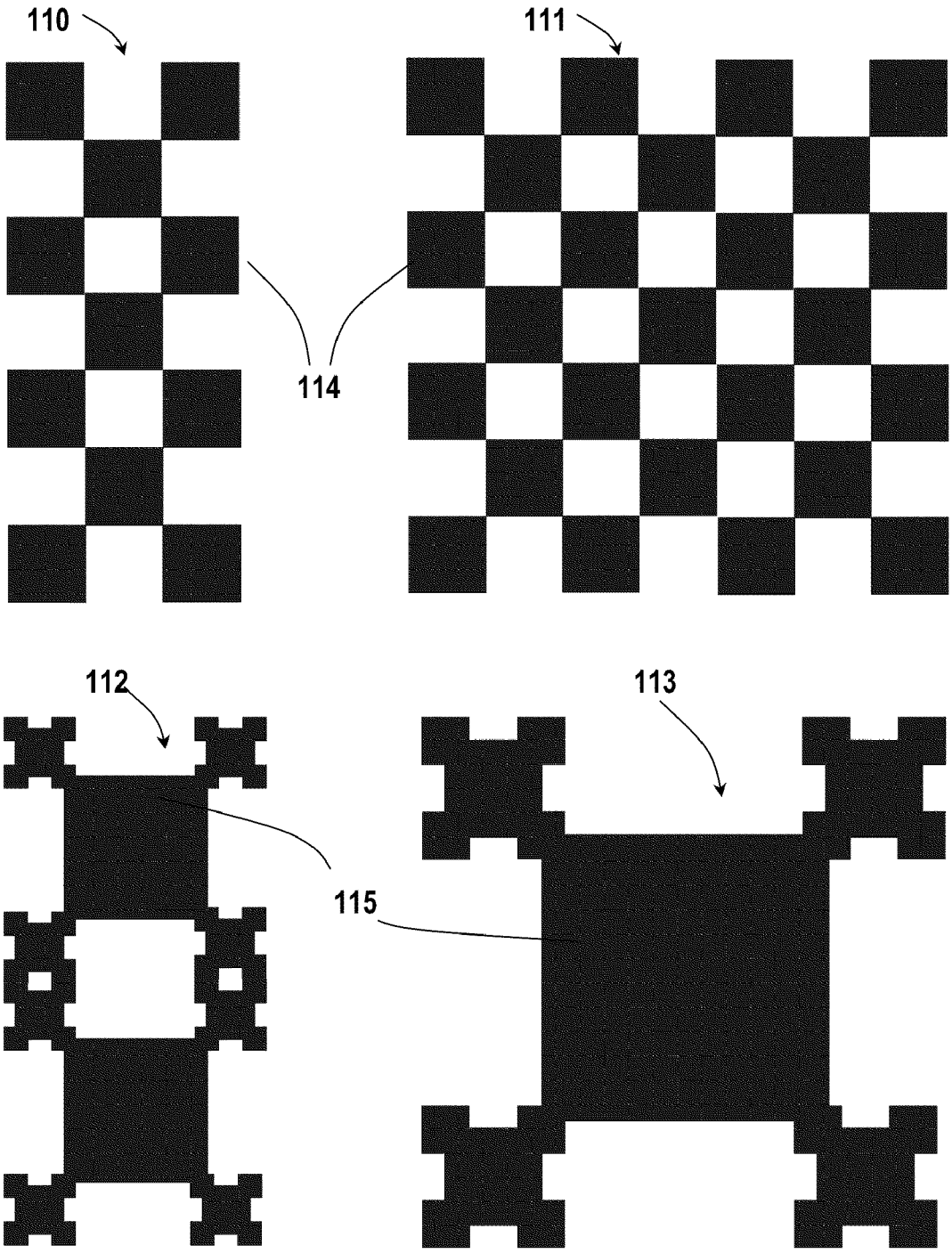
FIG. 17 shows another set examples of multilevel ground-planes.
Figure 18:
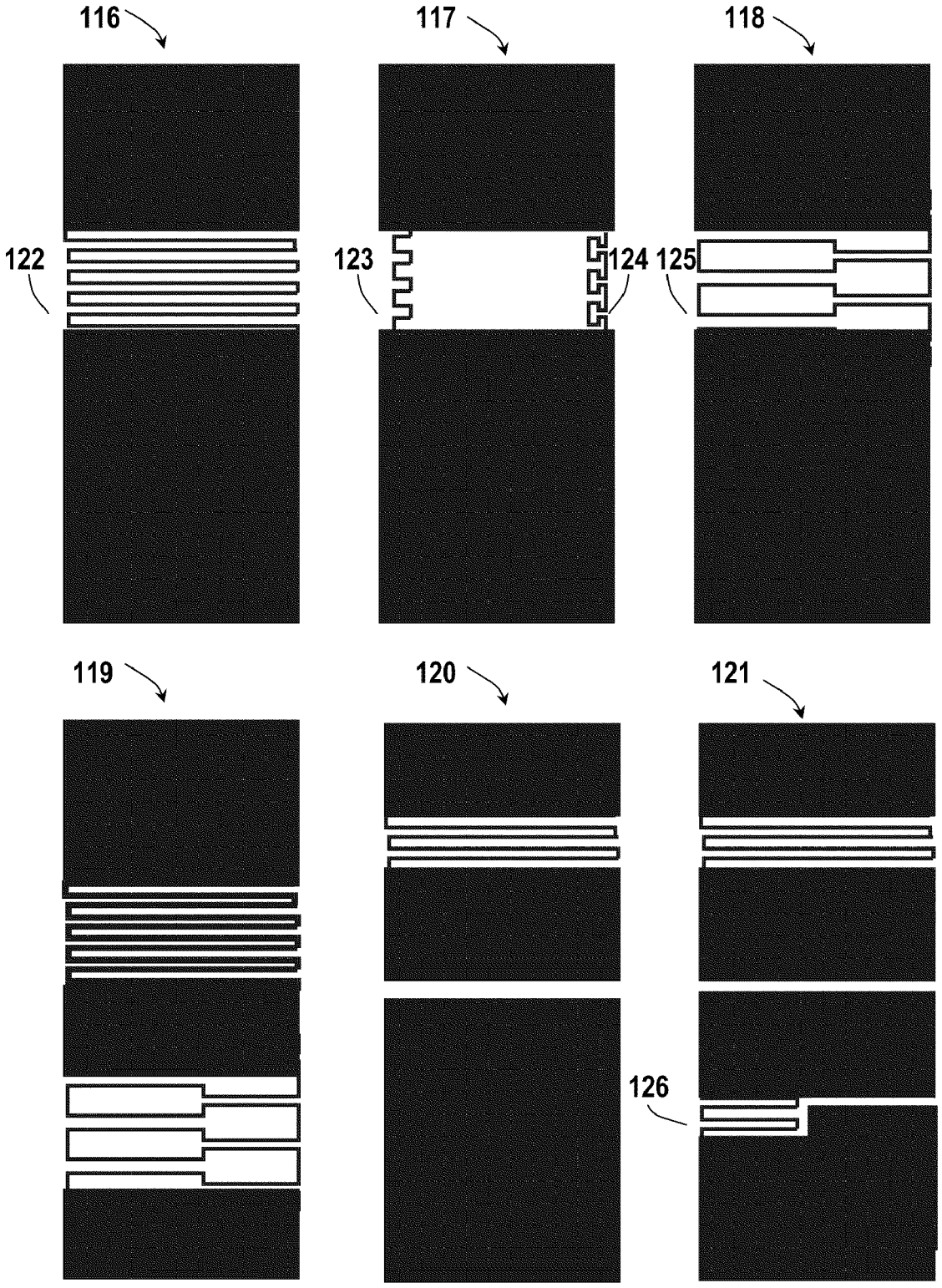
FIG. 18 shows examples of multilevel ground-planes where at least two conducting surfaces are being connected through meandering curves with different lengths or geometries. Some of said meandering lines can be replaced by SFC curves if a further size reduction or a different frequency behaviour is required.

In other preferred embodiments, conducting surfaces are connected by means of strips with SFC shapes, as in the examples shown in FIG. 3, 4, 5, 10, 11, 14, or 15. In said configurations, SFC curves can cover even more than the 50% of the area covered by said ground-plane as it happens in the cases of FIG. 14. In other cases, the gap between conducting surfaces themselves is shaped as an SFC curve as shown in FIG. 12 or 13. In some embodiments, SFC curves feature a box-counting dimension larger than one (at least for an octave in the abscissa of the log-log graph used in the box-counting algorithm) and can approach the so called Hilbert or Peano curves or even some ideally infinite curves known as fractal curves.

Another preferred embodiment of multilevel and space-filling ground-plane is the monopole configuration as shown in FIG. 4. FIG. 4A shows a prior art antenna system 32 composed by a monopole radiating element 33 over a common and conventional solid surface ground-plane 34. Prior art patents and scientific publications have dealt with several one-piece solid surfaces, being the most common ones circular and rectangular. However, in the new ground-plane configuration of our invention, multilevel and space-filling structures can be used to enhance either the return loss, or radiation efficiency, or gain, or bandwidth, or a combination of all the above, while reducing the size compared to antennas with a solid ground-plane. FIG. 4B shows a monopole antenna system 35 composed by a radiating element 36 and a multilevel and space-filling ground-plane 37. Here, the arm of the monopole 33 is presented as a cylinder, but any other structure can be obviously taken instead (even helical, zigzag, meandering, fractal, or SFC configurations, to name a few).

To illustrate that several modifications of the antenna can be done based on the same principle and spirit of the present invention, another preferred embodiment example is shown in FIG. 5, based on the patch configuration. FIG. 5A shows an antenna system 38 that consist of a conventional patch antenna with a polygonal patch 39 (squared, triangular, pentagonal, hexagonal, rectangular, or even circular, multilevel, or fractal, to name just a few examples) and a common and conventional one-piece solid ground-plane 40. FIG. 5B shows a patch antenna system 41 that consists of a radiating element 42 (that can have any shape or size) and a multilevel and space-filling ground-plane 43. The ground-plane 43 being showed in the drawing is just an example of how multilevel and space-filling structures can be implemented on a ground-plane.

Preferably, the antenna, the ground-plane or both are disposed on a dielectric substrate. This may be achieved, for instance, by etching techniques as used to produce PCBs, or by printing the antenna and the ground-plane onto the substrate using a conductive ink. A low-loss dielectric substrate (such as glass-fibre, a teflon substrate such as Cuclad® or other commercial materials such as Rogers® 4003 well-known in the art) can be placed between said patch and ground-plane. Other dielectric materials with similar properties may be substituted above without departing from the intent of the present invention. As an alternative way to etching the antenna and the ground-plane out of copper or any other metal, it is also possible to manufacture the antenna system by printing it using conductive ink. The antenna feeding scheme can be taken to be any of the well-known schemes used in prior art patch antennas as well, for instance: a coaxial cable with the outer conductor connected to the ground-plane and the inner conductor connected to the patch at the desired input resistance point; a microstrip transmission line sharing the same ground-plane as the antenna with the strip capacitively coupled to the patch and located at a distance below the patch, or in another embodiment with the strip placed below the ground-plane and coupled to the patch through an slot, and even a microstrip transmission line with the trip co-planar to the patch. All these mechanisms are well known from prior art and do not constitute an essential part of the present invention. The essential part of the present invention is the shape of the ground-plane (multilevel and/or space-filling), which contributes to reducing the size with respect to prior art configurations, as well as enhancing antenna bandwidth, VSWR, and radiation efficiency.

Figure 19:
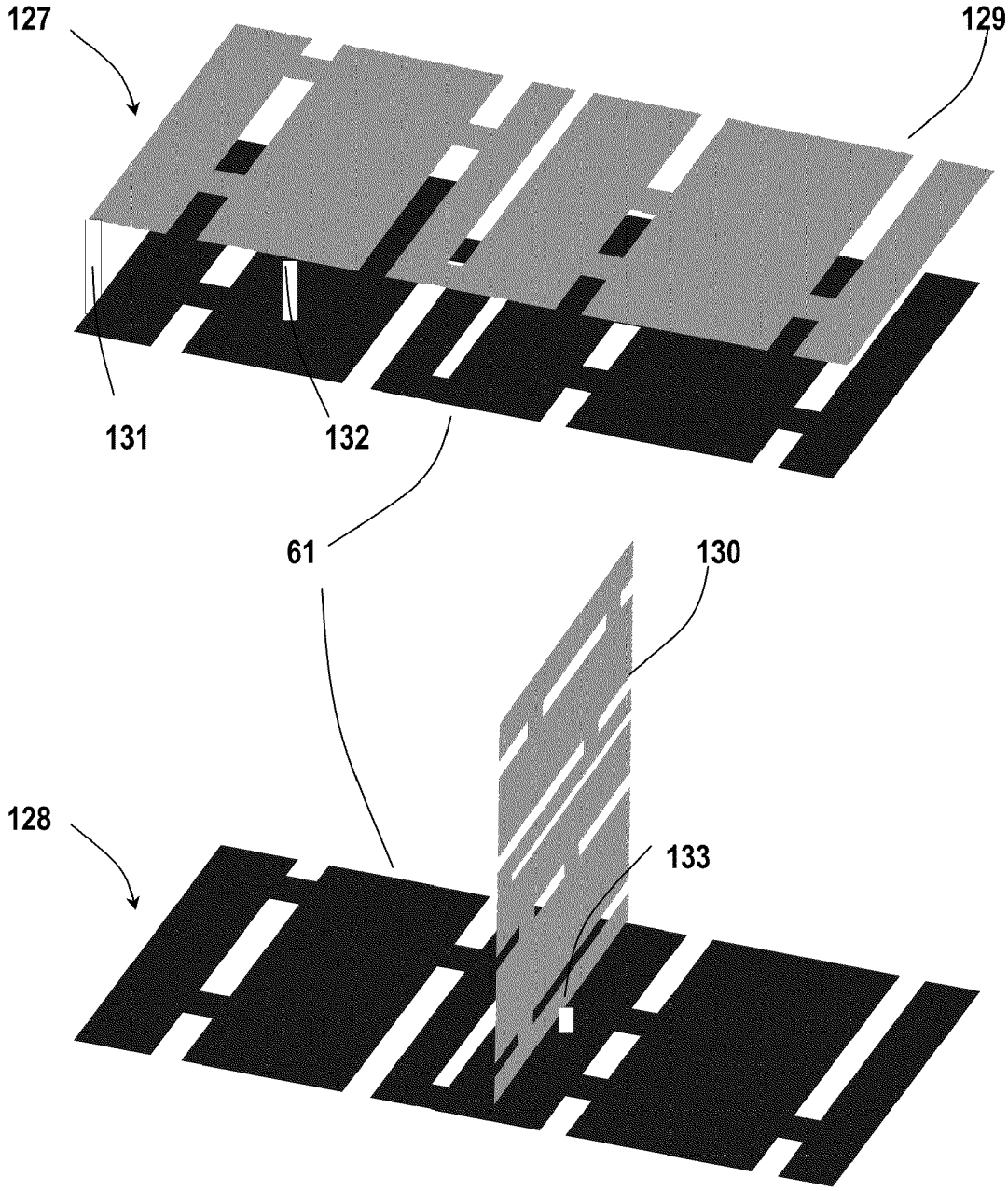
FIG. 19 shows examples of antennas wherein the radiating element has substantially the same shape as the ground-plane, thereby obtaining a symmetrical or quasymmetrical configuration, and where said radiating element is placed parallel (drawing 127) or orthogonal (drawing 128) to said ground-plane.

It is interesting to notice that the advantage of the ground-plane geometry can be used in shaping the radiating element in a substantially similar way. This way, a symmetrical or quasi-symmetrical configuration is obtained where the combined effect of the resonances of the ground-plane and radiating element is used to enhance the antenna behavior. A particular example of a microstrip (127) and monopole (128)

antennas using said configuration and design in drawing 61 is shown in FIG. 19, but it appears clear to any skilled in the art that many other geometries (other than 61) could be used instead within the same spirit of the invention. Drawing 127 shows a particular configuration with a short-circuited patch (129) with shorting post, feeding point 132 and said groundplane 61, but other configurations with no shorting post, pin, or strip are included in the same family of designs. In the particular design of the monopole (128), the feeding post is 133.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications, and substitutions without departing from the spirit and scope of the invention as set forth in the foregoing specification and following claims.

What is claimed:

1. A handheld wireless device comprising:

an antenna element, the antenna element including a feeding point;

a ground plane, the ground plane operating in cooperation with the antenna element;

a printed circuit board, the printed circuit board including a conducting layer;

a feeding means, the feeding means being arranged on the printed circuit board; and a dielectric support;

wherein the antenna element is arranged on the dielectric support;

wherein the feeding means are coupled to the feeding point of the antenna element;

wherein the ground plane comprises:

a first conducting surface and a second conducting surface, each of the first conducting surface and the second conducting surface having an elongated shape with two opposite ends;

wherein the first conducting surface is arranged as the conducting layer of the printed circuit board; and a conducting strip, the conducting strip connecting an end of the first conducting surface with an end of the second conducting surface and allowing current to flow between the first conducting surface and the second conducting surface;

wherein the conducting strip is narrower than a width of the first conducting surface and a width of the second conducting surface;

wherein the antenna element is shaped as a structure comprising:

a plurality of conducting polygon, the plurality of conducting polygons each having the same number of sides;

wherein the plurality of conducting polygons of the structure are electromagnetically coupled via either capacitive coupling or ohmic contact;

wherein a contact region between directly connected conducting polygons of the plurality of conducting polygons of the structure is smaller than half of a perimeter of the directly connected conducting polygons in at least seventy-five percent of the plurality conducting polygons of the structure; and wherein the antenna element is arranged adjacent to said end of the first conducting surface.

2. The handheld wireless device of claim 1, wherein:

said end of the first conducting surface and said end of the second conducting surface define a gap in the ground plane; and the antenna element is arranged with respect to said gap such that at least a portion of said gap overlaps a projection of the antenna element on a plane containing the ground plane.

3. The handheld wireless device of claim 1, wherein at least one of the first conducting surface, the second conducting surface, and the conducting strip defines a second structure;

wherein the second structure comprises a plurality of conducting polygons, each of the plurality of conducting polygons having the same number of sides;

wherein the plurality of conducting polygons are electromagnetically coupled via either capacitive coupling or ohmic contact; and wherein a contact region between directly connected conducting polygons of the plurality of conducting polygons is smaller than half of a perimeter of the directly connected conducting polygons in at least seventy-five percent of the conducting polygons of the second structure.

4. The handheld wireless device of claim 1, wherein the conducting strip is shaped as a curve comprising a plurality of connected segments;

wherein each segment of the plurality of connected segments is shorter than a tenth of an operating free-space wavelength of the antenna element; and wherein the plurality of connected segments are spatially arranged so that no two adjacent and connected segments form a longer straight segment.

5. The handheld wireless device of claim 4, wherein each segment of the plurality of connected segments is straight.

6. The handheld wireless device of claim 4, wherein the plurality of connected segments comprise at least ten segments.

7. The handheld wireless device of claim 1, wherein the dielectric support is mounted on the printed circuit board.

8. The handheld wireless device of claim 1, wherein the antenna element is a patch element of a patch antenna.

9. The handheld wireless device of claim 1, wherein the antenna element is a radiating arm of a monopole antenna.

10. The handheld wireless device of claim 1, wherein the handheld wireless device is a cellular telephone.

11. The handheld wireless device of claim 1, wherein the handheld wireless device is a personal digital assistant (PDA).

12. The handheld wireless device of claim 1, wherein:

the handheld wireless device provides at least three frequency bands having similar impedance levels and radiation patterns; and wherein the handheld wireless device is capable of at least one of transmitting and receiving wireless signals on selected channels, the selected channels selectable from a plurality of channels throughout an entire frequency range within each of said at least three frequency bands.

13. The handheld wireless device of claim 1, wherein:

the handheld wireless device provides at least four frequency bands having similar impedance levels and radiation patterns; and wherein the handheld wireless device is capable of at least one of transmitting and receiving wireless signals on selected channels, the selected channels selectable from a plurality of channels throughout an entire frequency range within each of said at least four frequency bands.

14. The handheld wireless device of claim 1, wherein:

the handheld wireless device provides at least five frequency bands having similar impedance levels and radiation patterns; and wherein the handheld wireless device is capable of at least one of transmitting and receiving wireless signals on selected channels, the selected channels selectable from a plurality of channels throughout an entire frequency range within each of said at least five frequency bands.

15. The handheld wireless device of claim 1, wherein the handheld wireless device provides at least one cellular phone service.

16. The handheld wireless device of claim 15, wherein the at least one cellular phone service is in a frequency range between about 1850 MHz and about 1990 MHz.

17. The handheld wireless device of claim 15, wherein the at least one cellular phone service is in a frequency range between about 2110 MHz and about 2155 MHz.

18. The handheld wireless device of claim 15, wherein the handheld at least one cellular phone service is in a frequency range between about 1710-1755 MHz and about 2110-2155 MHz.

19. The handheld wireless device of claim 1, wherein said handheld wireless device provides at least one of a GSM service and a UMTS service.

20. The handheld wireless device of claim 1, wherein said handheld wireless device provides at least three of AMPS, GSM900, GSMI800, DCS, PCSI900 and UMTS.

21. The handheld wireless device of claim 1, wherein said handheld wireless device provides at least four of AMPS, GSM900, GSMT800, DCS, PCS1900 and UMTS.

22. A handheld wireless device comprising:

an antenna element, the antenna element including a feeding point;

a ground plane, the ground plane operating in cooperation with the antenna element;

a first printed circuit board and a second printed circuit board, each of the first printed circuit board and the second printed circuit board including a conducting layer;

a feeding means, the feeding means being arranged on the first printed circuit board;

a dielectric support;

wherein the antenna element is arranged on the dielectric support; and wherein the feeding means are coupled to the feeding point of the antenna element;

wherein the ground plane comprises:

a first conducting surface and a second conducting surface, each of the first conducting surface and the second conducting surface having a plurality of sides defined by at least one edge;

wherein the first conducting surface is arranged as the conducting layer of the first printed circuit board;

wherein the second conducting surface is arranged as the conducting layer of the second printed circuit board; and a first conducting strip and a second conducting strip, each of the first conducting strip and the second conducting strip connecting the first conducting surface and the second conducting surface and allowing current to flow between the first conducting surface and the second conducting surface;

wherein the first conducting strip has a first width, the first width being narrower than a width of the first conducting surface and a width of the second conducting surface; and wherein the second conducting strip has a second width, the second width being narrower than the width of the first conducting surface and the width of the second conducting surface;

wherein at least one of the first conducting surface, the second conducting surface, the first conducting strip and the second conducting strip defines a first structure;

wherein the first structure comprises a plurality of conducting polygons, each of the plurality of conducting polygons having the same number of sides;

wherein the plurality of conducting polygons are electromagnetically coupled via either capacitive coupling or ohmic contact;

wherein a contact region between directly connected conducting polygons of the plurality of conducting polygons is smaller than half of a perimeter of the directly connected conducting polygons in at least seventy-five percent of the conducting polygons of the first structure;

wherein the antenna element is shaped as a second structure comprising:

a plurality of conducting polygons, the plurality of conducting polygons each having the same number of sides;

wherein the plurality of conducting polygons of the second structure are electromagnetically coupled via either capacitive coupling or ohmic contact; and wherein a contact region between directly connected conducting polygons of the plurality of conducting polygons of the second structure is smaller than half of the perimeter of the directly connected conducting polygons in at least seventy-five percent of the plurality conducting polygons of the second structure.

23. The handheld wireless device of claim 22, wherein:

said end of the first conducting surface and said end of the second conducting surface define a gap in the ground plane; and the antenna element is arranged with respect to said gap such that at least a portion of said gap overlaps a projection of the antenna element on a plane containing the ground plane.

24. The handheld wireless device of claim 22, wherein:

at least one of the first conducting strip and the second conducting strip is shaped as a curve comprising a plurality of connected segments;

wherein each segment of the plurality of connected segments is shorter than a tenth of an operating free-space wavelength of the antenna element; and wherein the plurality of connected segments are spatially arranged so that no two adjacent and connected segments form a longer straight segment.

25. The handheld wireless device of claim 22, wherein at least one of the first conducting strip and the second conducting strip has a width smaller than a tenth of a smaller of the width of the first conducting surface and the width of the second conducting surface.

26. The handheld wireless device of claim 22, wherein each of the first conducting strip and the second conducting strip has a width smaller than a tenth of a smaller of the width of the first conducting surface and the width of the second conducting surface.

27. The handheld wireless device of claim 22, wherein the first conducting strip and the second conducting strip have similar width.

28. The handheld wireless device of claim 22, claim the first conducting strip and the second conducting strip have similar length.

29. The handheld wireless device of claim 22, wherein the first conducting strip and the second conducting strip have similar shape.

30. The handheld wireless device of claim 22, wherein the first conducting strip and the second conducting strip are on a common planar or curved surface.

31. The handheld wireless device of claim 22, wherein a distance between the first conducting strip and the second conducting strip is not larger than a tenth of a smaller of the width of the first conducting surface and the width of the second conducting surface.

32. The handheld wireless device of claim 22, wherein:

said end of the first conducting surface and said end of the second conducting surface define a gap in the ground plane; and wherein the gap comprises two open ends and a midpoint gap substantially centered between said two open ends.

33. The handheld wireless device of claim 32, wherein the first conducting strip and the second conducting strip are located on opposite sides of said midpoint gap.

34. The handheld wireless device of claim 32, wherein the first conducting strip and the second conducting strip are located between the midpoint gap and one open end of said two open ends.

35. The handhold wireless device of claim 32, wherein the first conducting strip is located at an open end of said two open ends and aligned along an edge defining an external perimeter of the ground plane.

36. The handheld wireless device of claim 22, wherein the dielectric support is mounted on the first printed circuit board.

37. The handhold wireless device of claim 22, wherein the antenna element is a patch element of a patch antenna.

38. The handheld wireless device of claim 22, wherein the antenna element is a radiating arm of a monopole antenna.

39. The handhold wireless device of claim 22, wherein the handheld wireless device is a cellular telephone.

40. The handhold wireless device of claim 22, wherein the handhold wireless device is a personal digital assistant (PDA).

41. The handhold wireless device of claim 22, wherein:

the handhold wireless device provides at least three frequency bands having similar impedance levels and radiation patterns; and wherein the handhold wireless device is capable of at least one of transmitting and receiving wireless signals on selected channels, the selected channels selectable from a plurality of channels throughout an entire frequency range within each of said at least three frequency bands.

42. The handhold wireless device of claim 22, wherein:

the handhold wireless device provides at least four frequency bands having similar impedance levels and radiation patterns; and wherein the handhold wireless device is capable of at least one of transmitting and receiving wireless signals on selected channels, the selected channels selectable from a plurality of channels throughout an entire frequency range within each of said at least four frequency bands.

43. The handhold wireless device of claim 22, wherein:

the handhold wireless device provides at least five frequency bands having similar impedance levels and radiation patterns; and wherein the handhold wireless device is capable of at least one of transmitting and receiving wireless signals on selected channels, the selected channels selectable from a plurality of channels throughout an entire frequency range within each of said at least five frequency bands.

44. The handhold wireless device of claim 22, wherein the handhold wireless device provides at least one cellular phone service.

45. The handhold wireless device of claim 44, wherein the at least one cellular phone service is in a frequency range between about 1850 MHz and about 1990 MHz.

46. The handhold wireless device of claim 44, wherein the at least one cellular phone service is in a frequency range between about 2110 MHz and about 2155 MHz.

47. The handhold wireless device of claim 44, wherein the at least one cellular phone service is in a frequency range between about 1710-1755 MHz and about 2110-2155 MHz.

48. The handhold wireless device of claim 22, herein said handhold wireless device provides at least one of a GSM service and a UMTS service.

49. The handhold wireless device of claim 22, wherein said handhold wireless device provides at least three of AMPS, GSM900, GSM1800, DCS, PCS1900 and UMTS.

50. The handhold wireless device of claim 22, wherein said handhold wireless device provides at least four of AMPS, GSM900, GSM 1800, DCS, PCS1900 and UMTS.

* * * * *